US011815290B2

(12) United States Patent
Tatsumi et al.

(10) Patent No.: US 11,815,290 B2
(45) Date of Patent: Nov. 14, 2023

(54) HEAT SOURCE SYSTEM, HOT WATER SUPPLY SYSTEM, HOT WATER SUPPLY METHOD, AND HOT WATER SUPPLY CONTROL PROGRAM

(71) Applicant: PURPOSE CO., LTD., Fuji (JP)

(72) Inventors: Toshiya Tatsumi, Fuji (JP); Yuto Kubota, Fuji (JP)

(73) Assignee: PURPOSE CO., LTD., Fuji (JP)

( * ) Notice: Subject to any disclaimer, the term of this patent is extended or adjusted under 35 U.S.C. 154(b) by 73 days.

(21) Appl. No.: 17/603,443

(22) PCT Filed: May 21, 2020

(86) PCT No.: PCT/JP2020/020110
§ 371 (c)(1),
(2) Date: Oct. 13, 2021

(87) PCT Pub. No.: WO2020/241444
PCT Pub. Date: Dec. 3, 2020

(65) Prior Publication Data

US 2022/0205684 A1 Jun. 30, 2022

(30) Foreign Application Priority Data

May 31, 2019 (JP) ..... 2019-102748

(51) Int. Cl.
*F24H 15/31* (2022.01)
*F24D 12/02* (2006.01)
*F24H 15/238* (2022.01)

(52) U.S. Cl.
CPC ..... *F24H 15/238* (2022.01); *F24H 15/31* (2022.01)

(58) Field of Classification Search
CPC .... F24D 19/1069; F24D 3/08; F24D 17/0036; F22B 35/008; F22B 33/00; F22B 5/34; F24H 15/238; F24H 15/31; F24H 15/305
See application file for complete search history.

(56) References Cited

U.S. PATENT DOCUMENTS 9,175,864 B2 * 11/2015 Yun ..... F24D 3/02
9,476,583 B2 * 10/2016 Liu ..... F24D 12/02
(Continued)

FOREIGN PATENT DOCUMENTS

CN 103534534 A 1/2014
CN 104197502 A 12/2014
(Continued)

OTHER PUBLICATIONS

Office Action dated Sep. 5, 2022, issued in counterpart CN Patent application No. 202080040087.9 with English machine translation. (13 pages).
(Continued)

*Primary Examiner* — Gregory A Wilson
(74) *Attorney, Agent, or Firm* — WHDA, LLP

(57) ABSTRACT

A heat source system is to be connected to another heat source system. The heat source system includes a heat source device and a control part. The heat source device includes a water regulation valve configured to regulate a flow rate of supply water flowing in the device and is configured to heat the supply water. The control part is connected to the heat source device, and is configured to acquire flow rate information of the supply water supplied to the other heat source system and the heat source device, to close the water regulation valve when a flow rate of the supply water is 0 or more and less than a first set value, and to open the water regulation valve when the flow rate of the supply water is equal to or greater than the first set value.

11 Claims, 13 Drawing Sheets

(56) References Cited

U.S. PATENT DOCUMENTS

| | | | | |
|---|---|---|---|---|
| 9,885,484 | B2 * | 2/2018 | Young | F24D 19/1051 |
| 10,914,475 | B2 * | 2/2021 | Gagne | F24H 1/52 |
| 10,969,142 | B2 * | 4/2021 | Tsuda | F24D 19/1066 |
| 11,029,039 | B2 * | 6/2021 | Morita | F24D 3/08 |
| 11,149,965 | B2 * | 10/2021 | Kusachi | F24D 12/02 |
| 2013/0274948 | A1 | 10/2013 | Matsuo et al. | |
| 2016/0047558 | A1 * | 2/2016 | Shimada | F24D 3/02 237/63 |
| 2022/0003431 | A1 * | 1/2022 | Kageyama | F24D 19/1069 |

FOREIGN PATENT DOCUMENTS

| | | | |
|---|---|---|---|
| JP | 64-63749 | A | 3/1989 |
| JP | 2017-133735 | A | 8/2017 |
| JP | 2018-48782 | A | 3/2018 |

OTHER PUBLICATIONS

Office Action dated Nov. 8, 2022, issued in counterpart JP Patent Application No. 2019-102748 with English machine translation. (6 pages).

Notification of Transmittal of Copies of Translation of the International Preliminary Report on Patentability (Form PCT/IB/338) issued in counterpart International Application No. PCT/JP2020/020110 dated Dec. 9, 2021, with Forms PCT/IB/373 and PCT/ISA/237. (10 pages).

International Search Report dated Jul. 7, 2020, issued in counterpart International Application No. PCT/JP2020/020110, with English Translation. (6 pages).

Japanese Written Opinion of the International Searching Authority (Form PCT/ISA/237) dated Jul. 7, 2020, issued in counterpart International Application No. PCT/JP2020/020110. (3 pages).

* cited by examiner

HEAT SOURCE SYSTEM, HOT WATER SUPPLY SYSTEM, HOT WATER SUPPLY METHOD, AND HOT WATER SUPPLY CONTROL PROGRAM

TECHNICAL FIELD

The present disclosure relates to a hot water supply technique of including multiple heat sources and heating supply water to supply hot water.

BACKGROUND ART

For example, hot water is generated by heating with a hot water supply system and supplied. The number of water heaters included in the hot water supply system is set based on the maximum demand for hot water, for example. Therefore, the hot water supply system may include multiple water heaters. In a hot water supply system in which a tank type water heater and a tankless water heater are mixed, it is known that a water heater used for hot water supply is selected so as to achieve energy saving (e.g. , Patent Literature 1).

CITATION LIST

Patent Literature

Patent Literature 1: Japanese Laid-Open Patent Publication No. 2017-133735

SUMMARY OF INVENTION

Technical Problem

In an existing hot water supply system, one or some of multiple water heaters may be removed and a new water heater or new water heaters may be installed due to various reasons such as failure or replacement of equipment. To increase a hot water supply capacity, a new water heater may be disposed in an existing hot water supply system. Assuming that a water heater compatible with the existing hot water supply system is disposed, a choice of water heater is narrowed. Additionally, if a water heater compatible with the existing hot water supply system is newly disposed, for example, a control system of the hot water supply system is maintained. Therefore, introduction of other hot water supply systems having excellent energy-saving performance such as hybrid hot water supply systems will be delayed.

If a new hot water supply system is simply connected to the existing hot water supply system, both hot water supply systems enter an operating state and are in a hot water supply standby state. When hot water supply is started, water is supplied to both hot water supply systems. Even in a hot water supply amount at which heating of supply water is started, if one hot water supply system is in operation (i.e., a minimum flow rate required for a heating operation of one hot water supply system), it causes a disadvantage that both hot water supply systems don't start heating the supply water. For example, if the minimum flow rate required for a heating operation of one hot water supply system is 3 liters per minute, two simply connected hot water supply systems do not start the heating operation until a hot water supply demand reaches 6 liters per minute, which is twice the minimum flow rate, and therefore, hot water is not supplied until the demand for hot water becomes higher.

Patent Literature 1 does not disclose or suggest this problem, and the configuration disclosed in Patent Literature 1 cannot solve this problem.

Therefore, an object of the present disclosure is to provide a heat source system and a heat source device suitable for connection to an existing hot water supply system or other hot water supply equipment such as a water heater.

Solution to Problem

According to a first aspect of the present disclosure, a heat source system is to be connected to another heat source system. The heat source system includes a heat source device and a control part. The heat source device includes a water regulation valve configured to regulate a flow rate of supply water flowing in the device and is configured to heat the supply water. The control part is connected to the heat source device, and is configured to acquire flow rate information of the supply water supplied to the other heat source system and the heat source device, to close the water regulation valve when a flow rate of the supply water is 0 or more and less than a first set value, and to open the water regulation valve when the flow rate of the supply water is equal to or greater than the first set value.

In the heat source system, the first set value may be a value within a range from a flow rate value that is twice the minimum flow rate of a heating operation of the other heat source system to a maximum flow rate value.

In the heat source system, the first set value may be less than a flow rate value when a second heat source device included in the other heat source system starts operation.

In the heat source system, the first set value may be a value within a range from a flow rate value that is twice the minimum flow rate of a heating operation of the heat source device to a maximum flow rate value.

In the heat source system, the control part may close the water regulation valve when the flow rate of the supply water is equal to or less than a second set value smaller than the first set value.

The heat source system may further include a flow rate detecting means. The flow rate detecting means may be connected to the control part and may be to detect the flow rate of the supply water supplied to the other heat source system and the heat source device.

The heat source system may further include a water supply path, a water storage means, and a heating means. The water supply path may be connected to the heat source device. The water storage means may be connected to the water supply path and may be to supply the supply water to the water supply path. The heating means may be connected to the water storage means and may be to heat the water stored in the water storage means.

According to a second aspect of the present disclosure, a hot water supply system includes a water supply path, a heat source system, a heat source device, a flow rate detecting means, and a control part. The heat source system is connected to the water supply path to heat supply water supplied through the water supply path. The heat source device is connected to the water supply path, is connected in parallel to the heat source system, includes a water regulation valve configured to regulate a flow rate of supply water flowing in the device, and is configured to heat the supply water.

The flow rate detecting means is disposed on the water supply path to detect a first flow rate of supply water supplied to the heat source system and the heat source device. The control part is connected to the heat source device and the flow rate detecting means to acquire flow rate information of the first flow rate from the flow rate detecting means, and is configured to close the water regulation valve when the first flow rate is 0 or more and less than a set value and to open the water regulation valve when the first flow rate is equal to or greater than the set value.

In the hot water supply system, the heat source system may operate independently of the heat source device and may adjust a heating operation of the heat source system in accordance with a second flow rate of supply water supplied to the heat source system.

According to a third aspect of the present disclosure, a hot water storage unit can supply water to a plurality of heat source devices. The hot water storage unit includes a flow rate detecting means and a control part. The flow rate detecting means is configured to detect a flow rate of supply water supplied from the hot water storage unit. The control part is connected to the flow rate detecting means, and is configured to acquire flow rate information of the supply water supplied from the hot water storage unit to output a first instruction signal when the flow rate of the supply water is 0 or more and less than a first set value and to output a second instruction signal when the flow rate of the supply water is equal to or greater than the first set value.

In the hot water storage unit, the first instruction signal may be an instruction signal for closing a water regulation valve configured to regulate a flow rate of water supply flowing in one heat source device of the plurality of heat source devices, and the second instruction signal may be an instruction signal for opening the water regulation valve.

According to a fourth aspect of the present disclosure, a hot water supply method is a method for supplying hot water from a hot water supply system including a heat source system and a heat source device. The method includes acquiring flow rate information of supply water supplied to the heat source system and the heat source device, closing a water regulation valve of the heat source device to supply hot water from the heat source system when a flow rate of the supply water is 0 or more and less than a set value, and opening the water regulation valve to supply hot water from the heat source system and the heat source device when the flow rate of the supply water is equal to or greater than the set value.

According to a fifth aspect of the present disclosure, a hot water supply control program causes a computer to implement the functions of acquiring flow rate information of supply water supplied to a heat source system and a heat source device, outputting a valve closing instruction signal to the heat source device when a flow rate of the supply water is 0 or more and less than a set value, and outputting a valve opening instruction signal to the heat source device when the flow rate of the supply water is equal to or greater than the set value.

Advantageous Effect of Invention

According to the present disclosure, for example, the following effects can be obtained.

(1) The heat source device can be connected to the heat source system regardless of the type of the heat source system to which the device is connected. When the flow rate of the supply water is low, the supply water does not flow in the heat source device, or the flow of water in the heat source device is suppressed. Therefore, the hot water supply system including the heat source device and the heat source system can supply, for example, the minimum amount of hot water that the heat source system can supply alone, or the hot water corresponding to the minimum amount.

DESCRIPTION OF EMBODIMENTS

Embodiments will now be described with reference to the drawings.

First Embodiment

Figure 1:
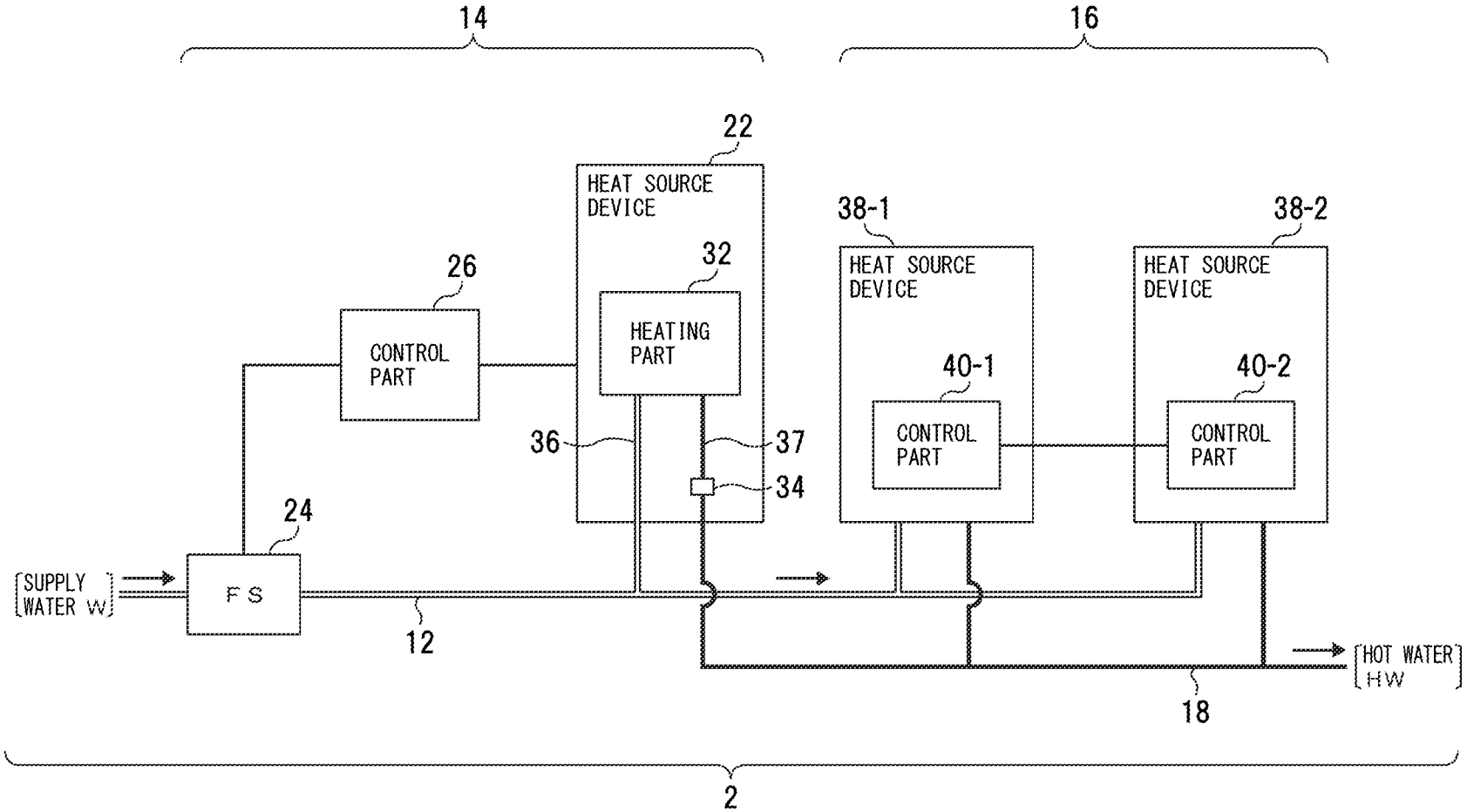
FIG. 1 is a diagram showing an example of a hot water supply system according to a first embodiment.

FIG. 1 shows an example of a hot water supply system according to a first embodiment.

A hot water supply system 2 includes a water supply path 12, a first heat source system 14, a second heat source system 16, and a hot water supply path 18. The hot water supply system 2 heats supply water W supplied through the water supply path 12 and supplies the heated supply water W, i.e., hot water HW, from the hot water supply path 18. The supply water W may be cold water or may be hot water having a temperature equal to or lower than the temperature of the hot water HW.

The water supply path 12 is connected to, for example, a water pipe and supplies the supply water W supplied from the water pipe to the first heat source system 14 and the second heat source system 16.

The first heat source system 14 is connected to the water supply path 12 and the hot water supply path 18. The first heat source system 14 includes a heat source device 22, a flow rate sensor (FS) 24, and a control part 26, and heats the supply water W supplied from the water supply path 12 to supply the hot water HW to the hot water supply path 18.

The heat source device 22 is an example of a first heat source device and is a water heater, for example. The heat source device 22 includes a heating part 32, a water regulation valve 34, an individual water supply pipe 36, and an individual hot water supply pipe 37, and heats the supply water W flowing in the heat source device 22 at the heating part 32. The individual water supply pipe 36 is connected to the water supply path 12, and the individual hot water supply pipe 37 is connected to the hot water supply path 18. Therefore, the heat source device 22 is connected to the water supply path 12 and the hot water supply path 18, and is connected in parallel to the second heat source system 16. The heating part 32 includes, for example, a burner and a heat exchanger, and heats the supply water W with combustion heat generated by combustion of gas, for example. The water regulation valve 34 is disposed on the individual hot water supply pipe 37, for example, and changes the flow rate of the supply water W flowing in the heat source device 22. The water regulation valve 34 maybe disposed on the individual water supply pipe 36. When the water regulation valve 34 is closed, the flow rate of the supply water W is zero or almost zero. Therefore, the water regulation valve 34 regulates the flow rate of the supply water W. When the water regulation valve 34 is opened, the supply water W flows in the heat source device 22.

A flow rate sensor 24 is disposed on the water supply path 12. The flow rate sensor 24 is an example of a flow rate detecting means, detects the flow rate of the supply water W supplied to the heat source device 22 of the first heat source system 14 and the second heat source system 16 (hereinafter referred to as "first flow rate"), and outputs flow rate information of the detected first flow rate to the control part 26. The flow rate sensor 24 is disposed upstream of the heat source device 22 and the second heat source system 16 in the water flow direction of the hot water supply system 2.

The control part 26 is communicably connected wirelessly or by wire to the heat source device 22 and the flow rate sensor 24. The control part 26 includes a computer, acquires the flow rate information of the first flow rate from the flow rate sensor 24, monitors the first flow rate, and outputs a valve closing instruction signal or a valve opening instruction signal for the water regulation valve 34 to the heat source device 22 on the basis of the first flow rate. The valve closing instruction signal is a first instruction signal to close the water regulation valve 34. The valve opening instruction signal is a second instruction signal to open the water regulation valve 34. The control part 26 switches the heat source device 22 to a suspended state or an operating state by outputting the valve closing instruction signal or the valve opening instruction signal. In the operating state of the heat source device 22, the water regulation valve 34 is opened. Therefore, the heat source device 22 heats the supply water W in accordance with the flow rate of the supply water W flowing in the heat source device 22, for example. In the suspended state of the heat source device 22, the water regulation valve 34 is closed. Therefore, the heat source device 22 does not heat the supply water W.

The second heat source system 16 is connected to the water supply path 12 and the hot water supply path 18. The second heat source system 16 is, for example, a multi-system of heat source devices, includes heat source devices 38-1, 38-2, and heats the supply water W from the water supply path 12 to supply the hot water HW to the hot water supply path 18. The second heat source system 16 can operate independently of the first heat source system 14 and adjusts the heating operation of the second heat source system 16 in accordance with the flow rate of the supply water W supplied to the second heat source system 16 (hereinafter referred to as "second flow rate"), for example. The adjustment of the heating operation includes, for example, changing the number of the heat source devices 38-1, 38-2 in the heating operation, and changing a heating amount of each of the heat source devices 38-1, 38-2. The second heat source system 16 detects a water supply flow rate of the supply water W supplied to each of the heat source devices 38-1, 38-2 by, for example, a flow rate sensor of each of the heat source devices 38-1, 38-2, and adds up the water supply flow rates of the heat source devices 38-1, 38-2 to obtain the second flow rate. The adding up of the water supply flow rates maybe performed by, for example, a dedicated control part, or may be performed by a simple controller of the heat source device 38-1 or the heat source device 38-2 designated as a master.

The heat source devices 38-1, 38-2 are examples of a second heat source device, and are water heaters, for example. The heat source devices 38-1, 38-2 are connected to the water supply path 12 and the hot water supply path 18, and are connected in parallel to the heat source device 22. The heat source devices 38-1, 38-2 can allow passage of the supply water W in the operating state, and heat the supply water W in accordance with the flow rate of the supply water W flowing in the heat source devices 38-1, 38-2. The heat source devices 38-1, 38-2 block the passage of the supply water W in the suspended state. The heat source devices 38-1, 38-2 include control parts 40-1, 40-2, respectively.

The control parts 40-1, 40-2 include computers, are, for example, multi-controllers, and communicate with each other between the control part 40-1 and the control part 40-2. Based on the second flow rate, the control parts 40-1, 40-2 execute processes, such as operating or suspending the heat source devices 38-1, 38-2, starting or stopping the heating operation, and designating the master, to control the second heat source system 16. The control part 40-1 transmits, for example, the water supply flow rate of the heat source device 38-1 to the control part 40-2, and the control part 40-2 transmits, for example, the water supply flow rate of the heat source device 38-2 to the control part 40-1. Therefore, for example, the control parts 40-1, 40-2 can add up the water supply flow rates.

Figure 2:
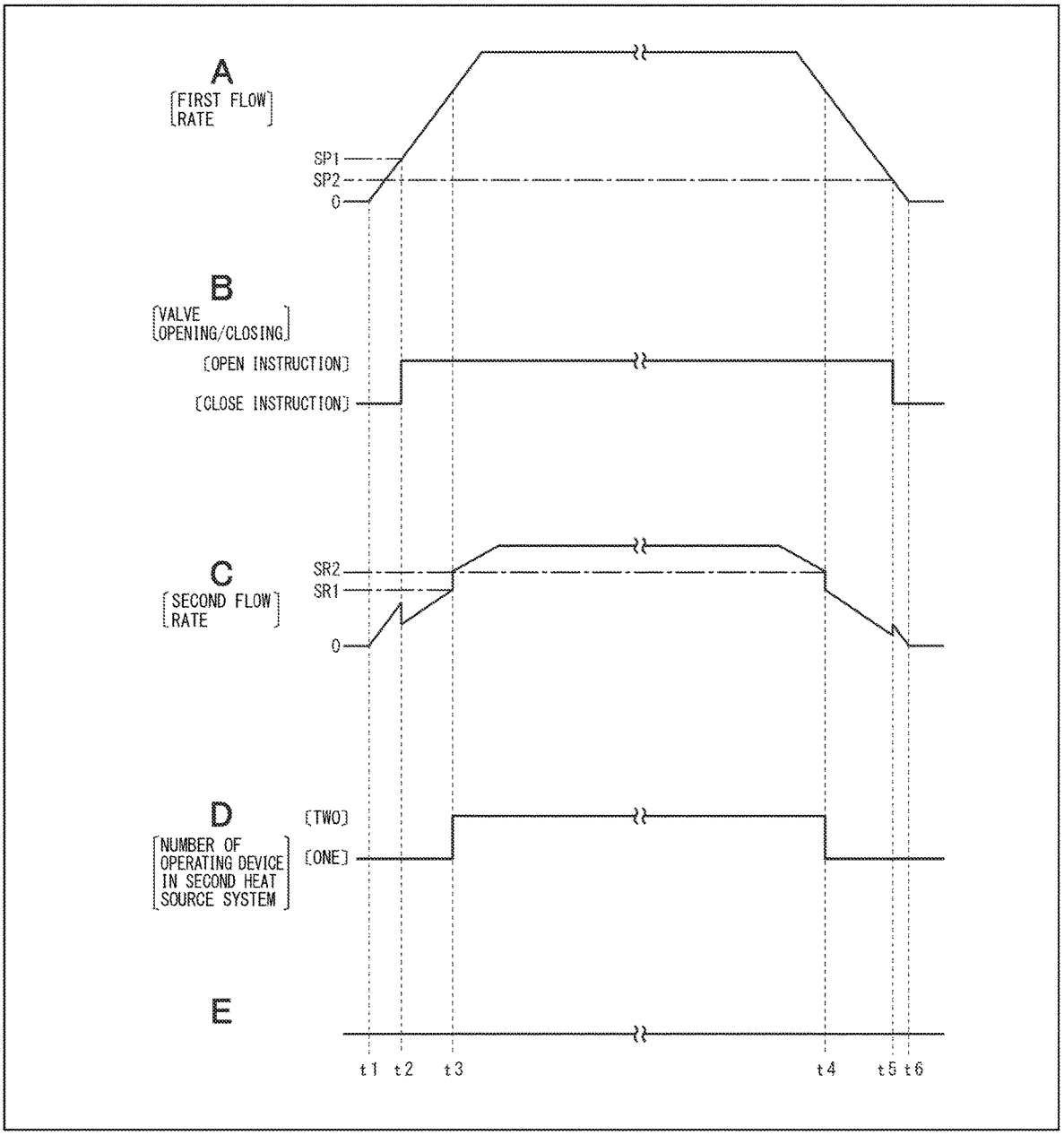
FIG. 2 is a diagram showing an example of a relationship between a flow rate of supply water and an operation status of a first heat source system and a second heat source system.

FIG. 2 shows an example of a relationship between the flow rate of the supply water W and the operating status of the first heat source system 14 and the second heat source system 16. A of FIG. 2 shows an example of a temporal change of the first flow rate. B of FIG. 2 shows an example of valve opening/closing of the water regulation valve 34. C of FIG. 2 shows an example of a temporal change of the second flow rate. D of FIG. 2 shows an example of the number of the operating heat source devices 38-1, 38-2 of the second heat source system 16. E of FIG. 2 shows an example of the time. The relationship shown in FIG. 2 is an example. The present disclosure is not limited to such relationships.

Figure 3:
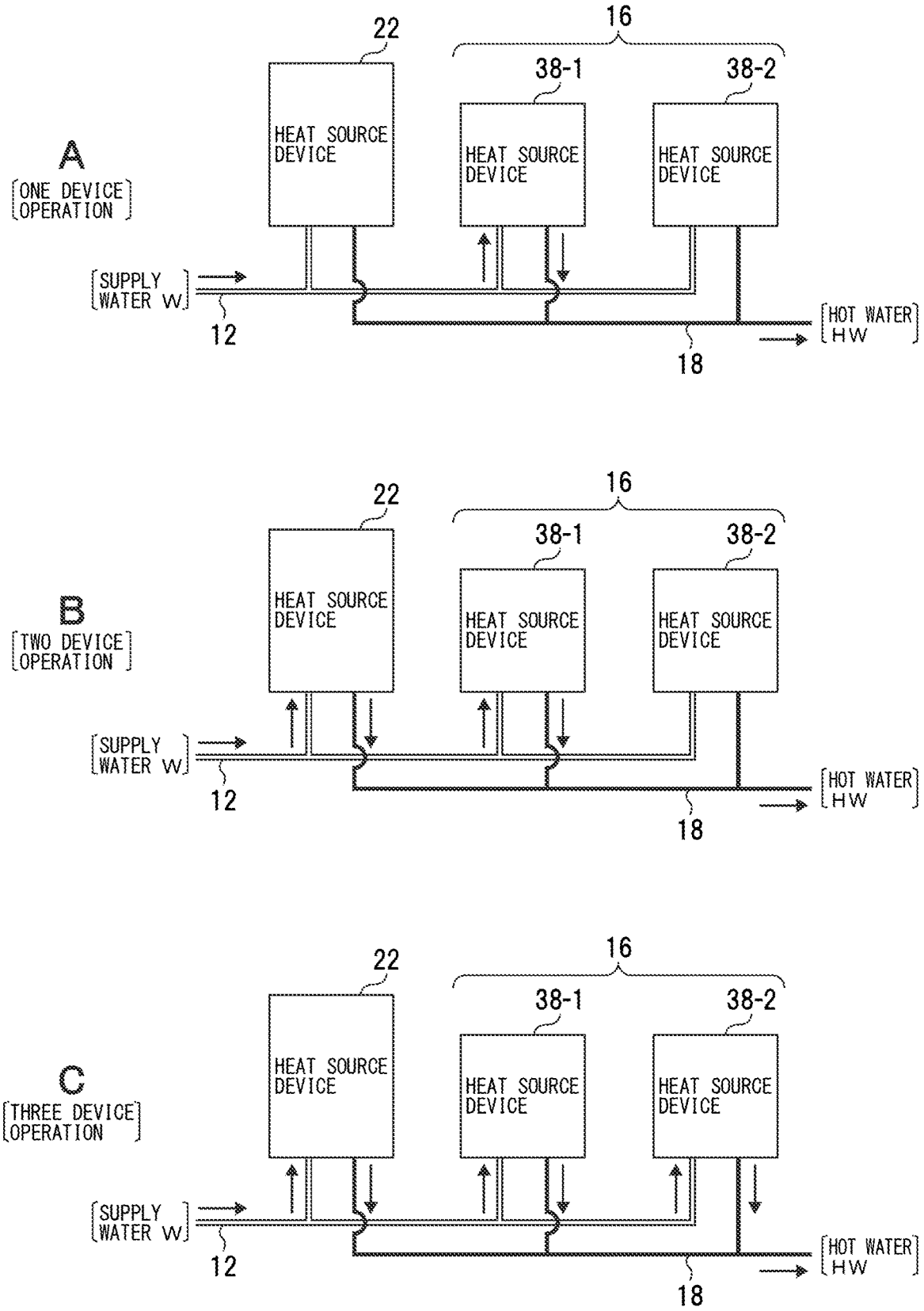
FIG. 3(A, B, and C) are diagrams showing examples of flows of supply water and hot water during hot water supply.

A, B, and C of FIG. 3 show examples of flows of the supply water and the hot water HW during hot water supply. A of FIG. 3 shows a state in which one heat source device is operating, B of FIG. 3 shows a state in which two heat source devices are operating, and C in FIG. 3 shows a state in which three heat source devices are operating.

Before the start of the hot water supply, the control part 26 outputs the valve closing instruction signal for the water regulation valve 34 to close the water regulation valve 34. Before the start of hot water supply, a first heat source device of the second heat source system 16 (hereinafter referred to as "first operating heat source device") is in the operating state. The first operating heat source device is a priority machine of the second heat source system 16 and may be either the heat source device 38-1 or 38-2. The first operating heat source device waits in a heatable state before the hot water supply is started.

The hot water supply is started at time t1, and the first flow rate then increases, for example. When the first flow rate is 0 or more and less than a first set value SP1, the control part 26 maintains the valve closing instruction signal and maintains the closed state of the water regulation valve 34. Therefore, the heat source device 22 of the first heat source system 14 maintains the suspended state. When the first flow rate is 0 or more and less than the first set value SP1, the supply water W passes through the first operating heat source device of the second heat source system 16, for example, the heat source device 38-1, as shown in A of FIG. 3. The second heat source system 16 starts, maintains, or stops the heating operation based on independent control. The first operating heat source device of the second heat source system 16 starts heating when the second flow rate is 3 liters per minute or more, for example.

The first set value SP1 is set to, for example, any value within a range from a flow rate value twice the minimum flow rate of the heating operation of the second heat source system 16 (hereinafter, referred to as "the flow rate value twice the minimum flow rate") to a maximum flow rate value. When the first set value SP1 is equal to or more than the flow rate value twice the minimum flow rate, the second flow rate after opening of the water regulation valve 34 can be made larger than the minimum flow rate. Therefore, the second heat source system 16 can be prevented from stopping heating due to a reduction in the second flow rate, and the insufficiently heated hot water HW can be prevented from being supplied.

When the first set value SP1 is equal to or less than the maximum flow rate value, the first heat source system 14 is operated before the second heat source system 16 reaches a supply limit of the hot water HW, and the insufficiently heated hot water HW can be prevented from being supplied.

The first set value SP1 is preferably set from the flow rate value twice the minimum flow rate to less than a flow rate value (hereinafter referred to as "operating flow rate value of the second device") at which the second heat source device of the second heat source system 16 (hereinafter referred to as "second operating heat source device") starts operation. When the first set value SP1 is less than the operating flow rate value of the second device, the heat source device 22 is operated before the second heat source device of the second heat source system 16 is operated. Therefore, the number of the operating heat source devices increases one by one. Such an increase in the number of the operating heat source devices can suppress a variation amount of the supply water W flowing into the first operating heat source device and a rate of the supply water W flowing into the newly operating heat source device 22, and therefore the supply of the hot water HW can be prevented from becoming instable. Additionally, such an increase in the number of the operating heat source devices prevents the amount of the supply water W supplied to the heat source devices from decreasing below the flow rate required for the heating operation, and thus, all the heat source devices in operation are prevented from stopping heating.

The hot water supply capacity of the heat source device 22 may be the same as or substantially the same as the hot water supply capacity of the heat source devices 38-1, 38-2. In this case, the first set value SP1 may be set based on the hot water supply capacity of the heat source device 22 and may be set to, for example, a value within a range from a flow rate value twice the minimum flow rate of the heating operation of the heat source device 22 to a maximum flow rate value.

The first set value SP1 is set to, for example, a value in a range of 8 to 12 liters per minute, e.g., 10 liters per minute. To heat 10 liters of water from 15° C. to 60° C. per minute, the hot water supply capacity of No. 18 is required. In this case, the number is an index representing the hot water supply capacity. When the heat source device has a capacity of supplying N liters of hot water having a temperature 25 degrees higher than the water temperature per minute, the hot water supply capacity of this heat source device is No. N. The set value of the hot water supply temperature is, for example, 60° C., and the numbers of the hot water supply capacity of the heat source devices 38-1, 38-2 are, for example, No. 24, No. 30, or No. 50. Therefore, if the first set value SP1 is 10 liters per minute, the operating heat source device has, for example, a remaining hot water supply capacity of No. 6 or more, i.e., a capacity of further heating 3.3 liters of water from 15° C. to 60° C. per minute. The water regulation valve 34 can be opened before the second operating heat source device is operated.

When the first flow rate reaches the first set value SP1 at time t2, the control part 26 outputs the valve opening instruction signal instead of the valve closing instruction signal to open the water regulation valve 34. Therefore, when the first flow rate is equal to or greater than the first set value SP1, the water regulation valve 34 is opened. Water starts flowing to the heat source device 22 of the first heat source system 14, and the heat source device 22 is operated. Therefore, as shown in B of FIG. 3, a portion of the supply water W passes through the first operating heat source device of the second heat source system 16, and the remaining portion of the supply water W passes through the heat source device 22 of the first heat source system 14. The first heat source system 14 and the second heat source system 16 heat the supply water W on the basis of the respective independent controls.

When the second flow rate reaches a first supply flow rate value SR1 at time t3, the second heat source system 16 operates the second operating heat source device on the basis of independent control. Therefore, as shown in C of FIG. 3, the supply water W passes through either the heat source device 22 of the first heat source system 14 or the heat source devices 38-1, 38-2 of the second heat source system 16, and the hot water HW is supplied in an amount satisfying a demand.

When the supply amount of the hot water HW decreases and the second flow rate reaches a second supply flow rate value SR2 at time t4, the second heat source system 16 suspends one of the operating heat source devices, i.e., the second operating heat source device at time t4, on the basis of independent control.

When the supply amount of hot water HW further decreases and the first flow rate reaches a second set value SP2 at time t5, the control part 26 outputs the valve closing instruction signal instead of the valve opening instruction signal to close the water regulation valve 34. Therefore, when the first flow rate is equal to or less than the second set value SP2, the water regulation valve 34 is closed and the heat source device 22 of the first heat source system 14 is suspended. After time t5, the supply water W passes through the operating heat source device of the second heat source system 16. The second heat source system 16 starts, maintains, or stops the heating operation on the basis of the independent control of the second heat source system 16.

The second set value SP2 is set to a value smaller than the first set value SP1, for example. The water regulation valve 34 is closed at the time of the first flow rate less than the first set value SP1, and therefore, when the first flow rate reaches the first set value SP1 again after the water regulation valve 34 is closed, the control part 26 can output the valve opening instruction signal to the water regulation valve 34. The second set value SP2 is set to a value away from the first set value SP1, for example. When the first flow rate oscillates around the first set value SP1 or the second set value SP2, a large set value difference between the first set value SP1 and the second set value SP2 prevents a chattering of the water regulation valve 34.

The second set value SP2 is set to a value that is a half of the first set value SP1, for example. The second set value SP2 is set to, for example, a value in a range of 4 to 6 liters per minute, for example, 5 liters per minute.

After time t5, the second heat source system 16 starts, maintains, or stops the heating operation on the basis of the independent control of the second heat source system 16. At the end of the hot water supply at time t6, the water regulation valve 34 is closed and one of the heat source devices of the second heat source system 16 is in operation. Therefore, when the hot water supply is restarted, the second heat source system 16 can restart the heating operation on the basis of the independent control.

Figure 4:
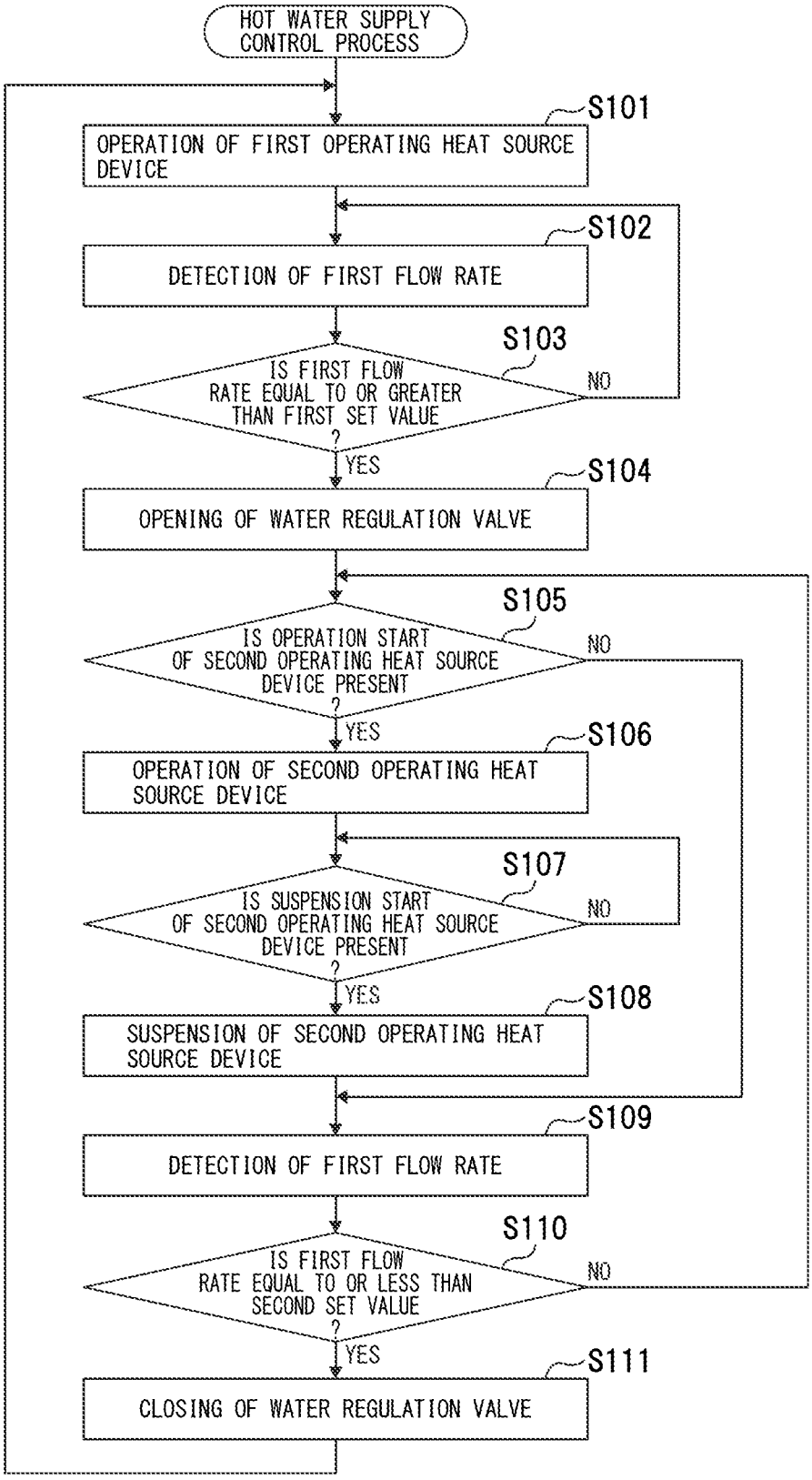
FIG. 4 is a flowchart showing an example of a hot water supply control process.

FIG. 4 is a flowchart showing an example of a hot water supply control process. This hot water supply control process is an example of a hot water supply method of the present disclosure. This hot water supply control process is implemented by the control part 26 of the first heat source system 14 and the control parts 40-1, 40-2 of the second heat source system 16 executing a hot water supply control program. The hot water supply control process shown in FIG. 4 is an example, and the hot water supply method of the present disclosure is not limited to this process. In FIG. 4, S denotes a process stage.

When the water regulation valve 34 is in the closed state, the second heat source system 16 operates the first operating heat source device (S101). The first operating heat source device starts a combustion operation under the independent control of the second heat source system 16. For example, when a demand for hot water supply of 3 liters per minute is generated by opening a hot water tap, the first operating heat source device starts the combustion operation.

The flow rate sensor 24 detects the first flow rate (S102) and outputs the flow rate information of the first flow rate to the control part 26. The control part 26 acquires the flow rate information of the first flow rate and determines whether the first flow rate is equal to or greater than the first set value SP1 (S103). If the first flow rate is less than the first set value SP1 (NO at S103), S102 and S103 are repeated. If the first flow rate is equal to or greater than the first set value SP1 (YES at S103), the control part 26 outputs the valve opening instruction signal to the heat source device 22, and the water regulation valve 34 is opened (S104). By opening the water regulation valve 34, the heat source device 22 starts operation.

The control part 40-1 or 40-2 of the second heat source system 16 determines whether an operation start of the second operating heat source device is present (S105). If the operation start of the second operating heat source device is present (YES at S105) , the control part 40-1 or 40-2 operates the second operating heat source device (S106). The control part 40-1 or 40-2 determines whether a suspension start of the second operating heat source device is present (S107) , and if the suspension start of the second operating heat source device is not present (NO at S107), S107 is repeated. If the suspension start of the second operating heat source device is present (YES at S107), the control part 40-1 or 40-2 suspends the second operating heat source device (S108).

If the operation start of the second operating heat source device is not present at S105 (NO at S105), S106 to S108 are skipped.

The flow rate sensor 24 detects the first flow rate (S109), and outputs the flow rate information of the first flow rate to the control part 26. The control part 26 acquires the flow rate information of the first flow rate and determines whether the first flow rate is equal to or less than the second set value SP2 (S110). If the first flow rate is greater than the second set value SP2 (NO at S110) , S105 to S109 are repeated. If the first flow rate is equal to or less than the second set value SP2 (YES at S110), the control part 26 outputs the valve closing instruction signal to the heat source device 22, and the water regulation valve 34 is closed (S111). By closing the water regulation valve 34, the passage of the supply water W to the heat source device 22 is blocked or substantially blocked. The closing of the water regulation valve 34 prevents the supply water W from being distributed to the first heat source system 14 side and the second heat source system 16 side when the hot water supply is restarted after the suspension of the hot water supply or when the amount of hot water supply is small. This prevents occurrence of a situation in which neither the first heat source system 14 nor the second heat source system 16 performs heating.

Figure 5:
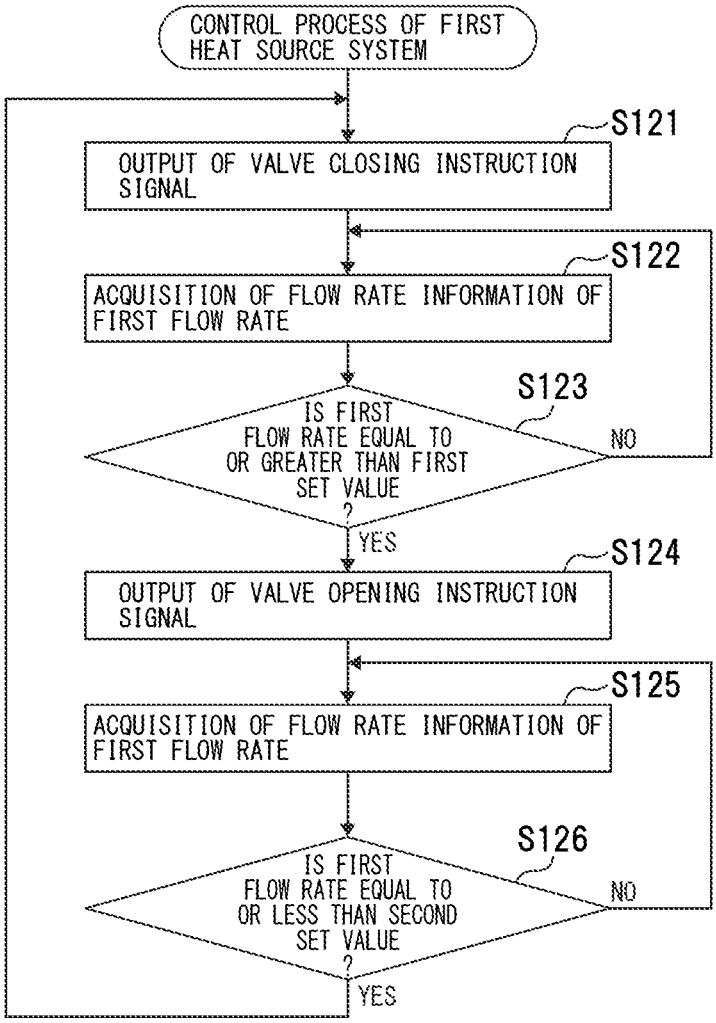
FIG. 5 is a flowchart showing an example of a control process of the first heat source system.

FIG. 5 is a flowchart showing an example of a control process of the first heat source system. This control process is an example of the hot water supply method of the present disclosure. This control process is implemented by the control part 26 executing the hot water supply control program. The control process shown in FIG. 5 is an example, and the hot water supply method of the present disclosure is not limited to this process. In FIG. 5, S denotes a process stage.

The control part 26 outputs the valve closing instruction signal (S121) and closes the water regulation valve 34.

The control part 26 acquires the flow rate information of the first flow rate (S122) and determines whether the first flow rate is equal to or greater than the first set value SP1 (S123). If the first flow rate is less than the first set value SP1 (NO at S123), S122 and S123 are repeated. If the first flow rate is equal to or greater than the first set value SP1 (YES at S123), the control part 26 outputs the valve opening instruction signal to the heat source device 22 (S124).

The control part 26 acquires the flow rate information of the first flow rate (S125) and determines whether the first flow rate is equal to or less than the second set value SP2 (S126). If the first flow rate is greater than the second set value SP2 (NO at S126), S125 and S126 are repeated. If the first flow rate is equal to or less than the second set value SP2 (YES at S126), the control process procedure returns to the output of the valve closing instruction signal (S121).

Figure 6:
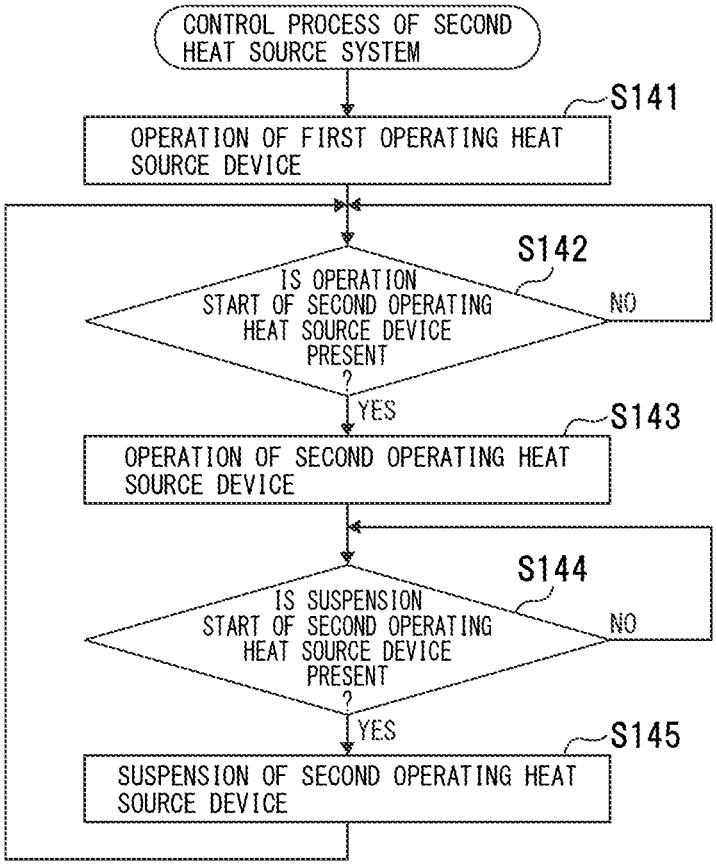
FIG. 6 is a flowchart showing an example of a control process of the second heat source system.

FIG. 6 is a flowchart showing an example of a control process of the second heat source system. This control process is an example of the hot water supply method of the present disclosure. This control process is implemented by the control parts 40-1, 40-2 executing the hot water supply control program. The control process shown in FIG. 6 is an example, and the hot water supply method of the present disclosure is not limited to this process. In FIG. 6, S denotes a process stage.

The first operating heat source device is operated (S141). The first operating heat source device in operation is in a state where water can be supplied. Therefore, when the demand for hot water supply reaches, for example, 3 liters per minute, the first operating heat source device starts the combustion operation. The control part 40-1 or 40-2 determines whether the operation start of the second operating heat source device is present (S142). If the operation start of the second operating heat source device is not present (NO at S142), S142 is repeated. If the operation start of the second operating heat source device is present (YES at S142), the control part 40-1 or 40-2 operates the second operating heat source device (S143).

The control part 40-1 or 40-2 determines whether the suspension start of the second operating heat source device is present (S144). If the suspension start of the second operating heat source device is not present (NO at S144), S144 is repeated. If the suspension start of the second operating heat source device is present (YES at S144), the control part 40-1 or 40-2 suspends the second operating heat source device (S145), and the control process returns to S142.

According to the first embodiment, for example, the following actions and effects can be obtained.

(1) Regardless of what kind of system the second heat source system 16 is, the first heat source system 14 can be connected to the second heat source system 16. When the flow rate of the supply water is small, the supply water W does not flow or hardly flows in the heat source device 22 of the first heat source system 14.

Therefore, the hot water supply system 2 can supply a minimum amount of hot water that the second heat source system 16 can independently supply, or an amount of hot water corresponding to this minimum amount.

(2) Even if the manufacturer, communication method, control program generation, system concept, etc. of the second heat source system 16 are different from those of the first heat source system 14, the first heat source system 14 can be connected to the second heat source system 16.

(3) Regardless of what kind of system an existing heat source system is, the first heat source system 14 can be introduced, and when the existing heat source system is partially replaced or the existing heat source system is enhanced in the hot water supply capacity, the range of choice of the heat source system or the heat source device is expanded.

(4) In the future, the heat source devices 38-1, 38-2 of the second heat source system 16 can be replaced with, for example, a heat source device compatible with the first heat source system 14. Therefore, the second heat source system 16 can be replaced with a hot water supply system including the first heat source system 14 and a heat source device or a heat source system adapted thereto after a state where the first heat source system 14 and the second heat source system 16 are installed in parallel.

Second Embodiment

Figure 7:
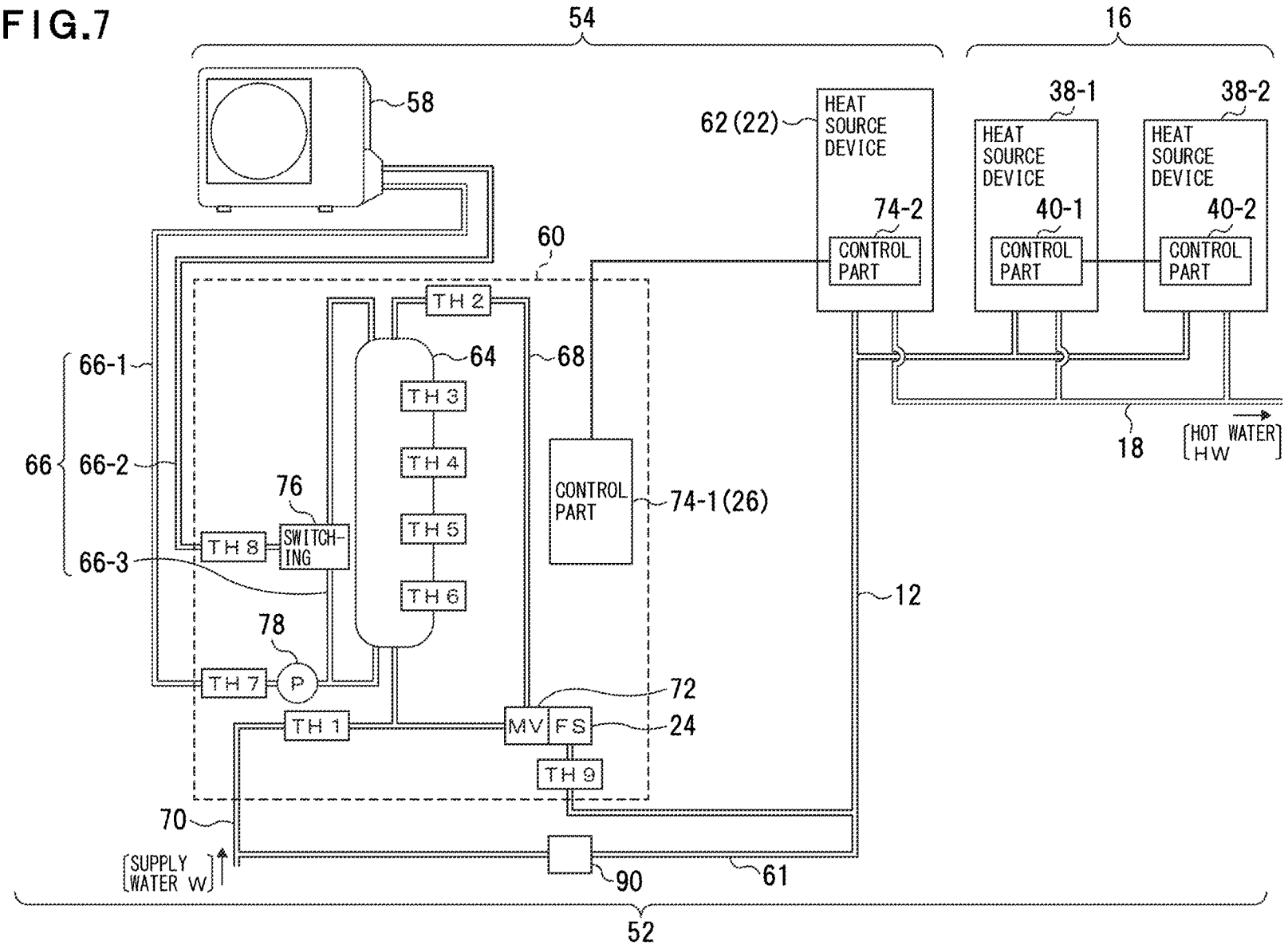
FIG. 7 is a diagram showing an example of a hot water supply system according to a second embodiment.

FIG. 7 shows an example of a hot water supply system according to a second embodiment. In FIG. 7, the same portions as FIG. 1 are denoted by the same reference signs and will not be described.

A hot water supply system 52 includes the water supply path 12, a first heat source system 54, a second heat source system 16, and the hot water supply path 18. The hot water supply system 52 heats the supply water W supplied through the water supply path 12 and supplies the heated supply water W, i.e., the hot water HW, from the hot water supply path 18. The supply water W may be cold water or may be hot water having a temperature equal to or lower than the temperature of the hot water HW. The water supply path 12, the second heat source system 16, and the hot water supply path 18 are the same as those of the first embodiment and will not be described.

The first heat source system 54 is connected to the water supply path 12 and the hot water supply path 18. The first heat source system 54 includes heat source devices 58, 62, a hot water storage unit 60, a bypass water supply pipe 61, and a remote-control device (not shown). The heat source device 58 and the hot water storage unit 60 are disposed upstream of the second heat source system 16 and the heat source device 62 in the water flow direction of the hot water supply system 52. The hot water heated by the heat source device 58 is stored in the hot water storage unit 60. The supply water W containing the hot water supplied from the hot water storage unit 60 is heated to a hot water supply temperature by the heat source device 62. Therefore, the first heat source system 54 is a hybrid hot water supply system having different types of the multiple heat source devices 58, 62, for example, and has a water supply preheating function by the heat source device 58. The supply water W including the hot water supplied from the hot water storage unit 60 may be hot water at a hot water supply temperature, or hot water or water at a temperature lower than the hot water supply temperature.

The heat source device 58 is an example of a third heat source device and a heating means and is connected to the hot water storage unit 60. The heat source device 58 includes, for example, a heat source unit such as a heat pump unit, and heats water supplied from the hot water storage unit 60 by a heat pump, for example, and returns the heated water to the hot water storage unit 60. The water supplied from the hot water storage unit 60 maybe cold water, hot water, or high-temperature water. The heated water may be either hot water or high-temperature water.

The hot water storage unit 60 includes a hot water storage tank 64, a circulation path 66, a hot water outlet pipe 68, a water supply pipe 70, a mixing valve 72, a flow rate sensor 24, and a control part 74-1, stores the water heated by the heat source device 58 in the hot water storage tank 64, and supplies the stored water to the heat source device 62 and the second heat source system 16. The water stored in the hot water storage tank 64 may be cold water, hot water, or high-temperature water.

The hot water storage tank 64 is an example of a water storage means, stores water, and supplies the water stored in the tank for hot water supply. The hot water storage tank 64 has a heat retaining function and suppresses a decrease in the temperature of the stored water.

The circulation path 66 includes pipelines 66-1, 66-2, 66-3. The pipe line 66-1 is connected to a lower portion of the hot water storage tank 64 and the heat source device 58. The pipe line 66-2 is connected to the heat source device 58 and an upper portion of the hot water storage tank 64 via a switching valve 76 on the pipe line 66-3. The pipe line 66-3 is a bypass pipe and is connected to the switching valve 76 and the pipe line 66-1. A pump 78 is disposed on the pipe line 66-1.

The switching valve 76 switches a destination of flow of water in the pipeline 66-2. When the pump 78 operates in a first switching state of the switching valve 76, the water in the lower portion of the hot water storage tank 64 circulates through the pipe line 66-1, the heat source device 58, the pipe line 66-2, and the pipe line 66-3. When the pump 78 operates in a second switching state of the switching valve 76, water flows through the pipe line 66-1, the heat source device 58, and the pipe line 66-2 into the upper portion of the hot water storage tank 64. Therefore, the water in the lower portion of the hot water storage tank 64 is returned to the upper portion of the hot water storage tank 64 after being heated to a heating set temperature such as 80° C. by the heat source device 58.

The hot water outlet pipe 68 is connected to the upper portion of the hot water storage tank 64 and is connected via the mixing valve 72 to the water supply path 12. Therefore, the water in the upper portion of the hot water storage tank 64 is supplied to the water supply path 12 through the hot water outlet pipe 68 and the mixing valve 72. The water supply pipe 70 is connected to the lower portion of the hot water storage tank 64 and the mixing valve 72, supplies water to the lower portion of the hot water storage tank 64, and supplies water through the mixing valve 72 to the water supply path 12.

The mixing valve 72 mixes the water flowing from the water supply pipe 70 with the water flowing from the hot water outlet pipe 68 so that the temperature of the water supplied to the water supply path 12 becomes the set temperature, for example. The flow rate sensor 24 is disposed on the water supply path 12 and measures a flow rate of the water flowing from the mixing valve 72, i.e., a flow rate of the supply water W supplied from the hot water storage unit 60.

The control part 74-1 is an example of the control part 26 described in the first embodiment, has a function of the control part 26, and has a function of controlling the hot water storage unit 60 based on temperature detected by temperature sensors TH1 to TH9.

The bypass water supply pipe 61 is connected in parallel to the hot water storage unit 60. The supply water W flowing through the bypass water supply pipe 61 is supplied through the water supply path 12 to the second heat source system 16 and the heat source device 62. The bypass water supply pipe 61 is opened or closed by opening and closing a bypass valve 90 disposed on the bypass water supply pipe 61, and the water in the bypass water supply pipe 61 flows or stagnates. The bypass valve 90 is opened and closed by the control part 74-1 on the basis of the flow rate information of the first flow rate output from the flow rate sensor 24, for example. Therefore, the supply water W is supplied through at least one of the hot water storage unit 60 and the bypass water supply pipe 61 to the second heat source system 16 and the heat source device 62.

Figure 8:
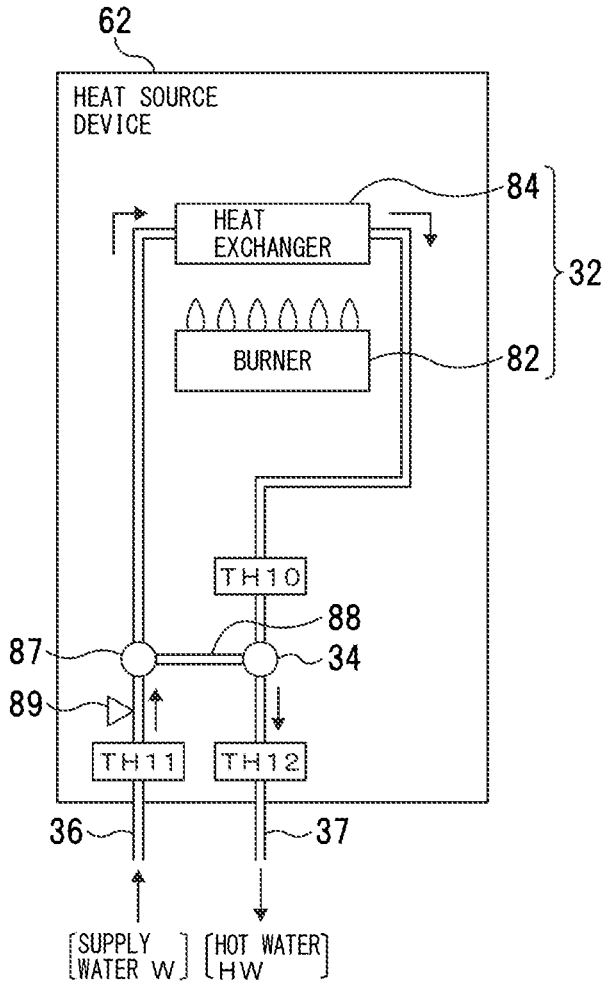
FIG. 8 is a diagram showing an example of a heat source apparatus.

FIG. 8 shows an example of a heat source device. In FIG. 8, the same portions as FIG. 1 are denoted by the same reference signs and will not be described.

The heat source device 62 is an example of the heat source device 22 described in the first embodiment. Regarding the heat source device 62, the heat source device 22 described in the first embodiment will not be described.

The heat source device 62 is a water heater having a boiler, for example. The heat source device 62 includes a burner 82, a heat exchanger 84, a mixing ratio distribution valve 87, an individual water supply pipe 36 and an individual hot water supply pipe 37, a water regulation valve 34, a bypass path 88, a flow rate sensor 89, temperature sensors TH10 to TH12, and a control part 74-2 (FIG. 7).

The burner 82 and the heat exchanger 84 are examples of the heating part 32 described above and combust fuel such as gas, oil, or kerosene and heat the supply water W with heat of obtained exhaust gas.

The water regulation valve 34 is disposed on the individual hot water supply pipe 37, and the bypass path 88 is connected to the mixing ratio distribution valve 87 on the individual water supply pipe 36 and the water regulation valve 34 on the individual hot water supply pipe 37.

When the water regulation valve 34 is opened, the supply water W flowing through the individual water supply pipe 36 is divided by the mixing ratio distribution valve 87 into the heat exchanger 84 side and the bypass path 88 side, flows together through the water regulation valve 34, and is supplied to the individual hot water supply pipe 37. In this way, the temperature of the hot water HW flowing through the individual hot water supply pipe 37 is adjusted.

The flow rate sensor 89 and the temperature sensors TH10 to TH12 are used for adjusting the combustion in the burner 82 and adjusting the amount of the supply water W flowing through the bypass path.

Figure 9:
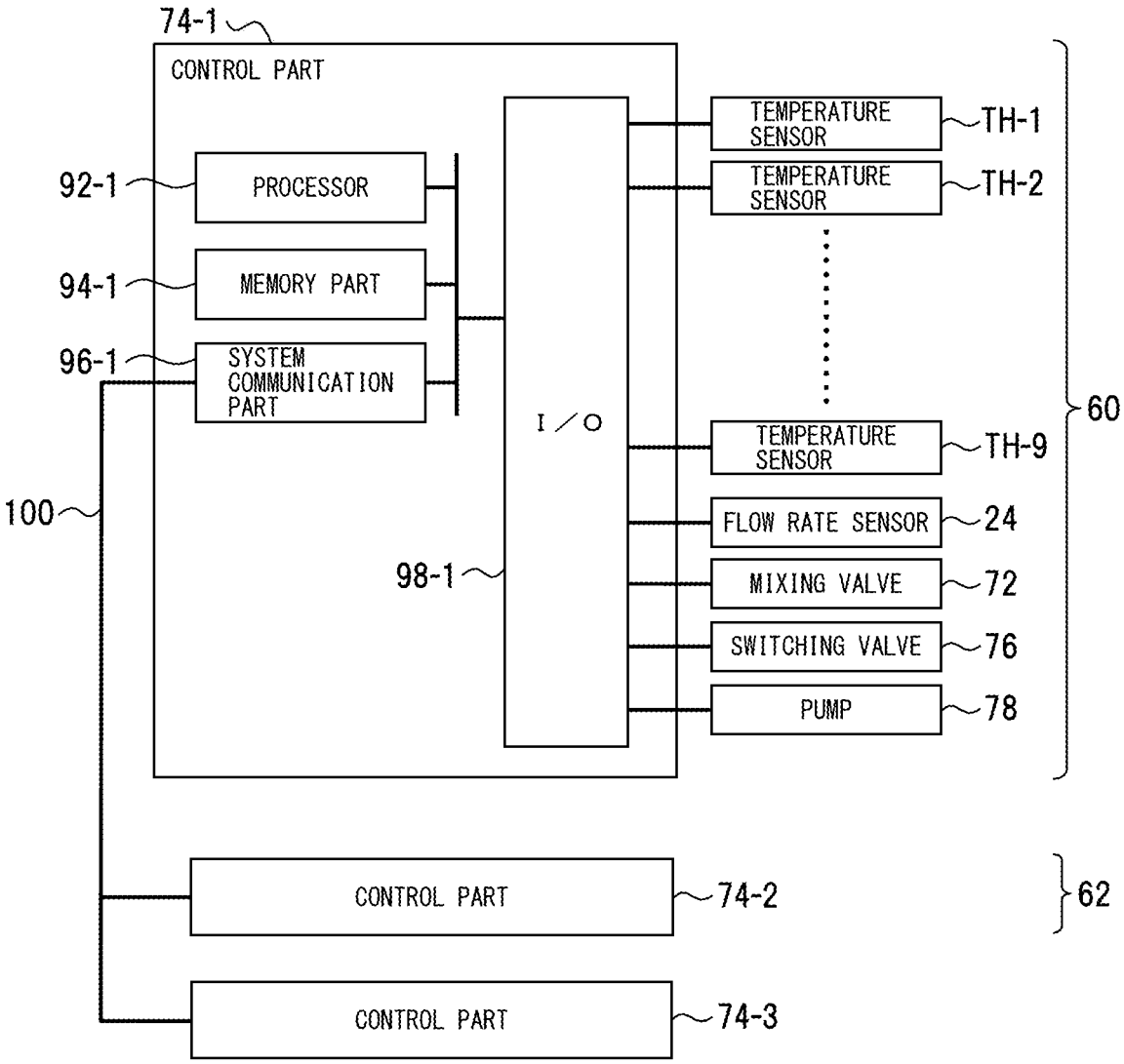
FIG. 9 is a diagram showing an example of a control system of the first heat source system.
Figure 10:
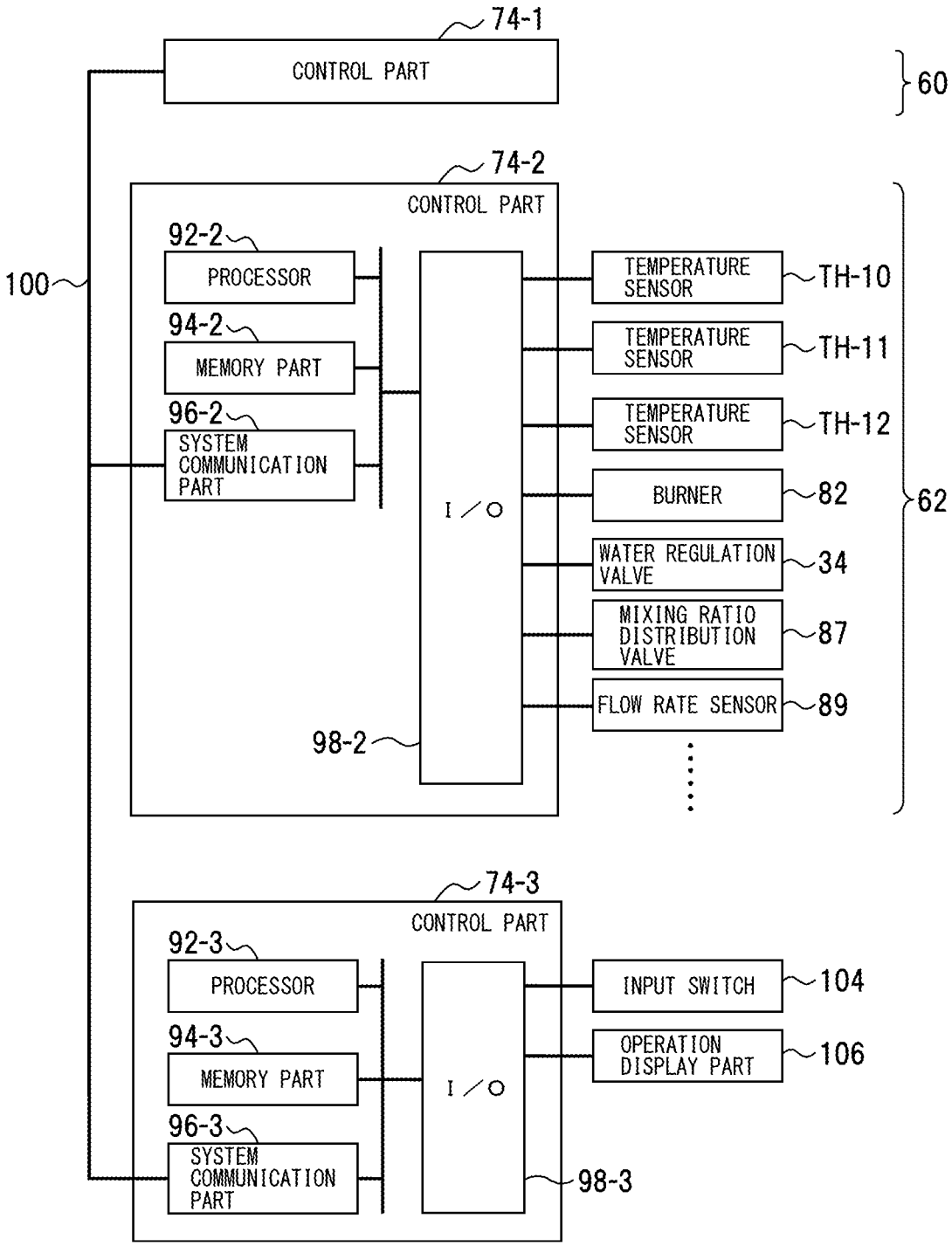
FIG. 10 is a diagram showing an example of the control system of the first heat source system.

FIGS. 9 and 10 show an example of a control system of the first heat source system.

The control part 74-1 of the hot water storage unit 60 includes a processor 92-1, a memory part 94-1, a system communication part 96-1, and an input/output part (I/O) 98-1. The processor 92-1 executes a program stored in the memory part 94-1 to implement the function of the control part 26 described in the first embodiment and further implement control functions of the hot water storage unit 60 such as a function of monitoring the temperature of water inside and outside the hot water storage tank 64, a function of circulating water passing through the heat source device 58, and a function of adjusting a mixing ratio of make-up water in the mixing valve 72.

The memory part 94-1 stores a program, set values such as the first set value SP1 and the second set value SP2, information obtained by information processing, etc. The memory part 94-1 is a recording medium such as a hard disk and a semiconductor memory, and is, for example, a non-volatile memory. The memory part 94-1 includes a ROM (Read-Only Memory) and a RAM (Random-Access Memory).

The system communication part 96-1 is connected through a communication cable 100 to the control part 74-2 of the heat source device 62 and a control part 74-3 of the remote-control device and is controlled by the processor 92-1 to transmit and receive control information between the parts. Although the communication cable 100 is shown as a single line, the communication cable 100 includes, for example, two communication circuits of the control part 74-2 and the control part 74-3.

The I/O 98-1 is connected to the temperature sensors TH1 to TH9, the flow rate sensor 24, the mixing valve 72, the switching valve 76, and the pump 78 disposed in the hot water storage unit 60. The I/O 98-1 acquires detection signals from the temperature sensors TH1 to TH9 and the flow rate sensor 24, and outputs control signals to the mixing valve 72, the switching valve 76, and the pump 78.

The control part 74-2 of the heat source device 62 controls the functional parts including the water regulation valve 34 based on the detected temperatures of the parts. The control part 74-3 of the remote-control device cooperates with the control parts 74-1, 74-2, sends instruction signals related to, for example, hot water supply, to the control parts 74-1, 74-2, and displays information sent from the control parts 74-1, 74-2.

The control part 74-2 is a computer and includes a processor 92-2, a memory part 94-2, a system communication part 96-2, and an I/O 98-2. The processor 92-2 executes a program stored in the memory part 94-2 to control the heat source device 62.

The memory part 94-2 stores a program, set values, control information obtained by information processing, etc. The memory part 94-2 is a recording medium such as a hard disk and a semiconductor memory, and is, for example, a non-volatile memory. The memory part 94-2 includes a ROM and a RAM.

The system communication part 96-2 is connected through the communication cable 100 to the control parts 74-1, 74-3 and is controlled by the processor 92-2 to transmit and receive the control information between the parts.

The I/O 98-2 is connected to the temperature sensors TH-10, TH-11, TH-12, the burner 82, the water regulation valve 34, the mixing ratio distribution valve 87, the flow rate sensor 89, etc. The I/O 98-2 acquires detection signals from the temperature sensors TH-10, TH-11, TH-12, the flow rate sensor 89, etc. and outputs control output to the burner 82, the mixing ratio distribution valve 87, etc.

The control part 74-3 is a computer and includes a processor 92-3, a memory part 94-3, a system communication part 96-3, and an I/O 98-3. The processor 92-3 executes a program stored in the memory part 94-3. For example, the processor 92-3 controls the remote-control device and displays information related to the first heat source system 54.

The memory part 94-3 stores a program, set values, control information obtained by information processing, etc. The memory part 94-3 is a recording medium such as a hard disk and a semiconductor memory and is, for example, a non-volatile memory. The memory part 94-3 includes a ROM and a RAM.

The system communication part 96-3 is connected through the communication cable 100 to the control parts 74-1, 74-2 and is controlled by the processor 92-3 to transmit and receive the control information between the parts.

The I/O 98-3 is connected to an input switch 104, an operation display part 106, etc. of the remote-control device. The input switch 104 is an example of an operation input unit, includes a touch sensor, for example, and is used for turning on the power, inputting a set temperature, etc. The operation display part 106 includes a display device such as an LCD (Liquid Crystal Display) and displays control information, input information, and warning information received from the hot water storage unit 60, the heat source device 58 or the heat source device 62 as an image, for example.

The hot water supply system 52 can supply the hot water HW by performing the hot water supply control process, the control process of the first heat source system, and the control process of the second heat source system described in the first embodiment, for example. These processes of the hot water supply system 52 will not be described.

Figure 11:
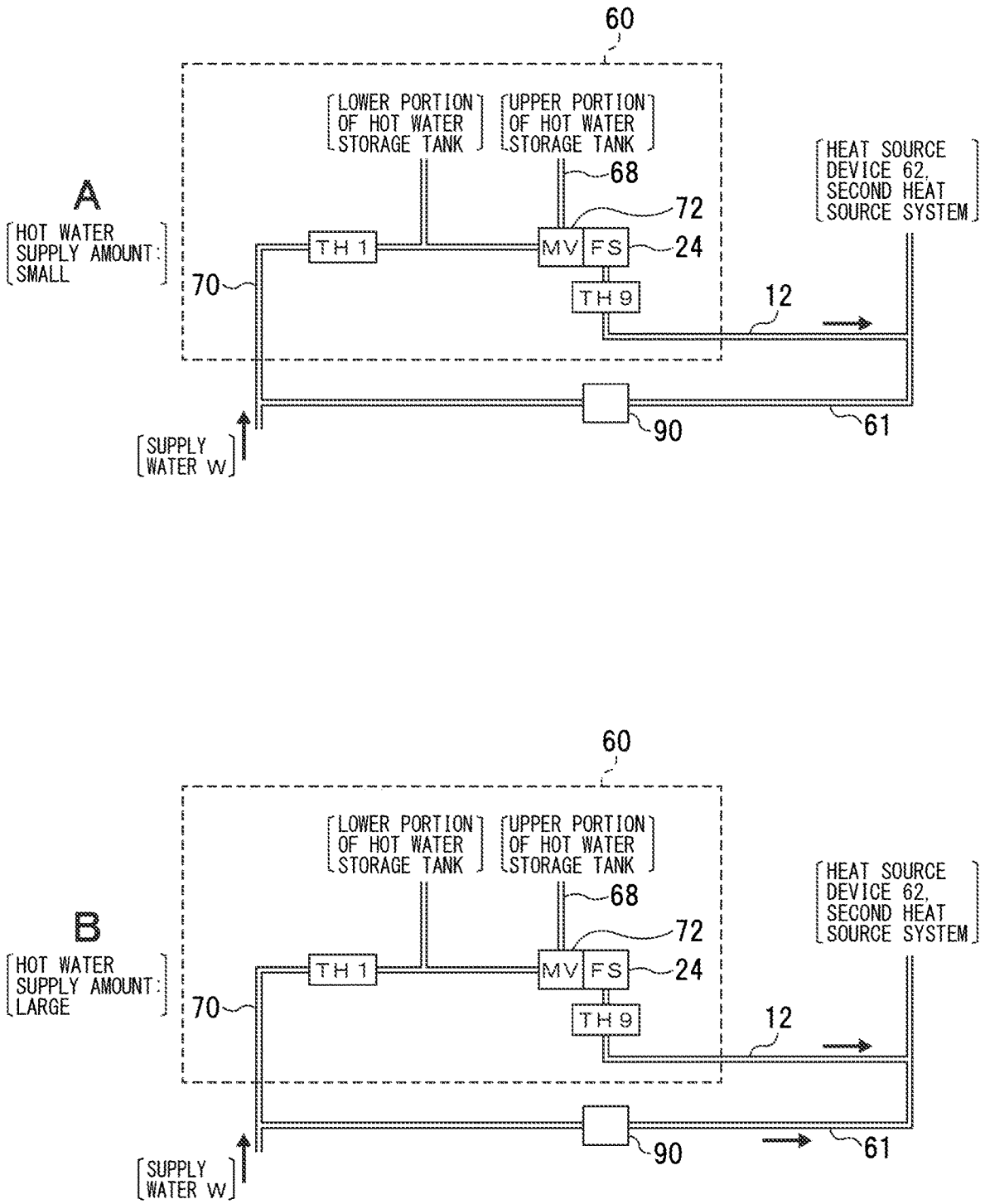
FIG. 11(A and B) are diagrams showing examples of flows of supply water.

A and B of FIG. 11 show examples of flows of the supply water W. In A and B of FIG. 11, arrows indicate the flow of the supply water W.

When a water supply amount is small, the bypass valve 90 is closed and the supply water W is supplied to the hot water storage unit 60 as shown in A of FIG. 11. Specifically, all the supply water W is supplied from the hot water storage unit 60 to the water supply path 12, so that all the supply water W flows through the flow rate sensor 24.

When the flow rate of the supply water W from the hot water storage unit 60, i.e., the first flow rate, reaches a first water supply flow rate due to an increase in water supply demand, the bypass valve 90 is opened, and as shown in B of FIG. 11, a first portion of the supply water W is supplied from the hot water storage unit 60 to the water supply path 12, and a second portion of the supply water W is supplied from the bypass water supply pipe 61 to the water supply path 12.

The first water supply flow rate is a flow rate equal to or less than the maximum water supply flow rate from the hot water storage unit 60 and is, for example, a flow rate greater than the first set value SP1. When the first water supply flow rate is such a flow rate, the supply water W supplied to the water supply path 12 is not supplied from the bypass water supply pipe 61 before the operation of the heat source device 62, and the control part 74-1 can determine whether the first flow rate is equal to or greater than the first set value SP1 and output the valve opening instruction signal to the heat source device 62. Additionally, the flow rate of the supply water W from the hot water storage unit 60 immediately after opening of the bypass valve 90 is adjusted to a flow rate larger than the second set value SP2, for example. Due to such adjustment, the first flow rate does not become equal to or less than the second set value SP2 immediately after opening of the bypass valve 90, and the control part 74-1 does not output the valve closing instruction signal to the heat source device 62 immediately after opening of the bypass valve 90.

When the flow rate of the supply water W from the hot water storage unit 60 becomes the second water supply flow rate due to a decrease in the water supply demand, the bypass valve 90 is closed. The second water supply flow rate is, for example, a flow rate greater than the second set value SP2. Due to such adjustment of the second water supply flow rate, when the second portion of the supply water W is supplied from the bypass water supply pipe 61, the flow rate of the supply water W from the hot water storage unit 60 does not become equal to or less than the second set value SP2. Therefore, when the flow rate of the supply water W from the hot water storage unit 60 becomes the second set value SP2, all the supply water W is supplied from the hot water storage unit 60 to the water supply path 12. Therefore, the control part 74-1 can determine whether the first flow rate is equal to or less than the second set value SP2 without considering the supply water W from the bypass water supply pipe 61, and output the valve closing instruction signal to the heat source device 62.

Figure 12:
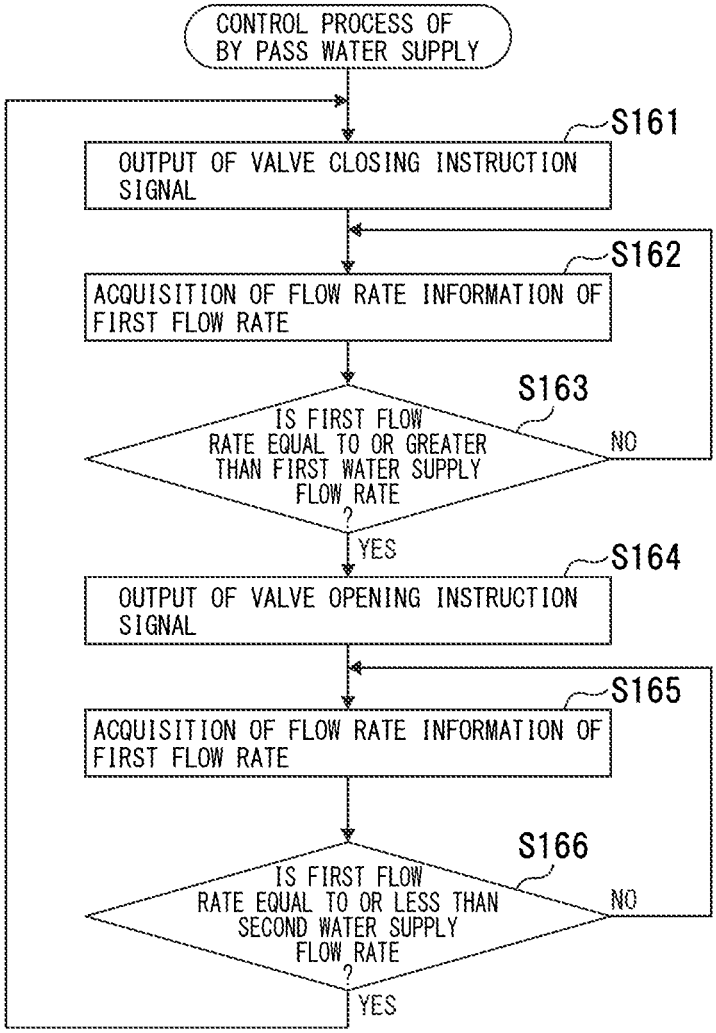
FIG. 12 is a flowchart showing an example of a control process of bypass water supply.

FIG. 12 is a flowchart showing an example of a control process of bypass water supply. This control process is an example of the hot water supply method of the present disclosure and is implemented by, for example, the control part 74-1 executing the hot water supply control program. The control process shown in FIG. 12 is an example, and the hot water supply method of the present disclosure is not limited to this process. In FIG. 12, S denotes a processing step.

For example, the control part 74-1 outputs the valve closing instruction signal to the bypass valve 90 (S161) and closes the bypass valve 90.

The control part 74-1 acquires the flow rate information of the first flow rate (S162) and determines whether the first flow rate is equal to or greater than the first water supply flow rate (S163). If the first flow rate is less than the first water supply flow rate (NO at S163), S162 and S163 are repeated. If the first flow rate is equal to or greater than the first water supply flow rate (YES at S163) , the control part 74-1 outputs the valve opening instruction signal to the bypass valve 90 (S164) to open the bypass valve 90.

The control part 74-1 acquires the flow rate information of the first flow rate (S165) and determines whether the first flow rate is equal to or less than the second water supply flow rate (S166). If the first flow rate is greater than the second water supply flow rate (NO at S166) , S165 and S166 are repeated. If the first flow rate is equal to or less than the second water supply flow rate (YES at S166), the control process procedure returns to the output of the valve opening instruction signal (S161) , and the control part 74-1 closes the bypass valve 90.

The second water supply flow rate is set to a value different from the first water supply flow rate. Chattering of the bypass valve 90 is suppressed by the set value difference between the first water supply flow rate and the second water supply flow rate.

According to the second embodiment, for example, the same actions and effects as the first embodiment can be obtained. Additionally, according to the second embodiment, for example, the following actions and effects can be obtained.

(1) The heat source device 58 and the hot water storage unit 60 of the first heat source system 54 are disposed upstream of the second heat source system 16 and the heat source device 62. Therefore, the supply water W can be preheated by the heat source device 58 and the hot water storage unit 60. When the heat source device 58 includes the heat pump unit, carbon dioxide is not discharged from the heat source device 58 when the supply water W is heated. The heat source device 58 including the heat pump unit can suppress the carbon dioxide emission of the hot water supply system 52 and reduce consumption energy, particularly, primary energy.

(2) The flow rate sensor 24 and the control part 74-1 included in the hot water storage unit 60 can be used for detecting and monitoring the flow rate of the supply water W flowing in the second heat source system 16 and the heat source device 62.

(3) When the second heat source system 16 is a multi-system including multiple water heaters coupled to each other, a hybrid hot water supply system including a heat pump and a water heater, for example, can be connected to this multi-system without setting communication between this multi-system and the hybrid hot water supply system. The hybrid hot water supply system can be introduced when the existing multi-system is partially replaced.

(4) For example, when a portion of the multi-system of gas water heaters breaks down, or when it is desired to introduce a hybrid hot water supply system including a heat pump and an energy-saving heat source device such as a solar water heater, a device or system of a different manufacturer can be introduced.

(5) For example, a hybrid system and a multi-system of gas water heaters using different communication methods can operate as a series of systems.

Third Embodiment

Figure 13:
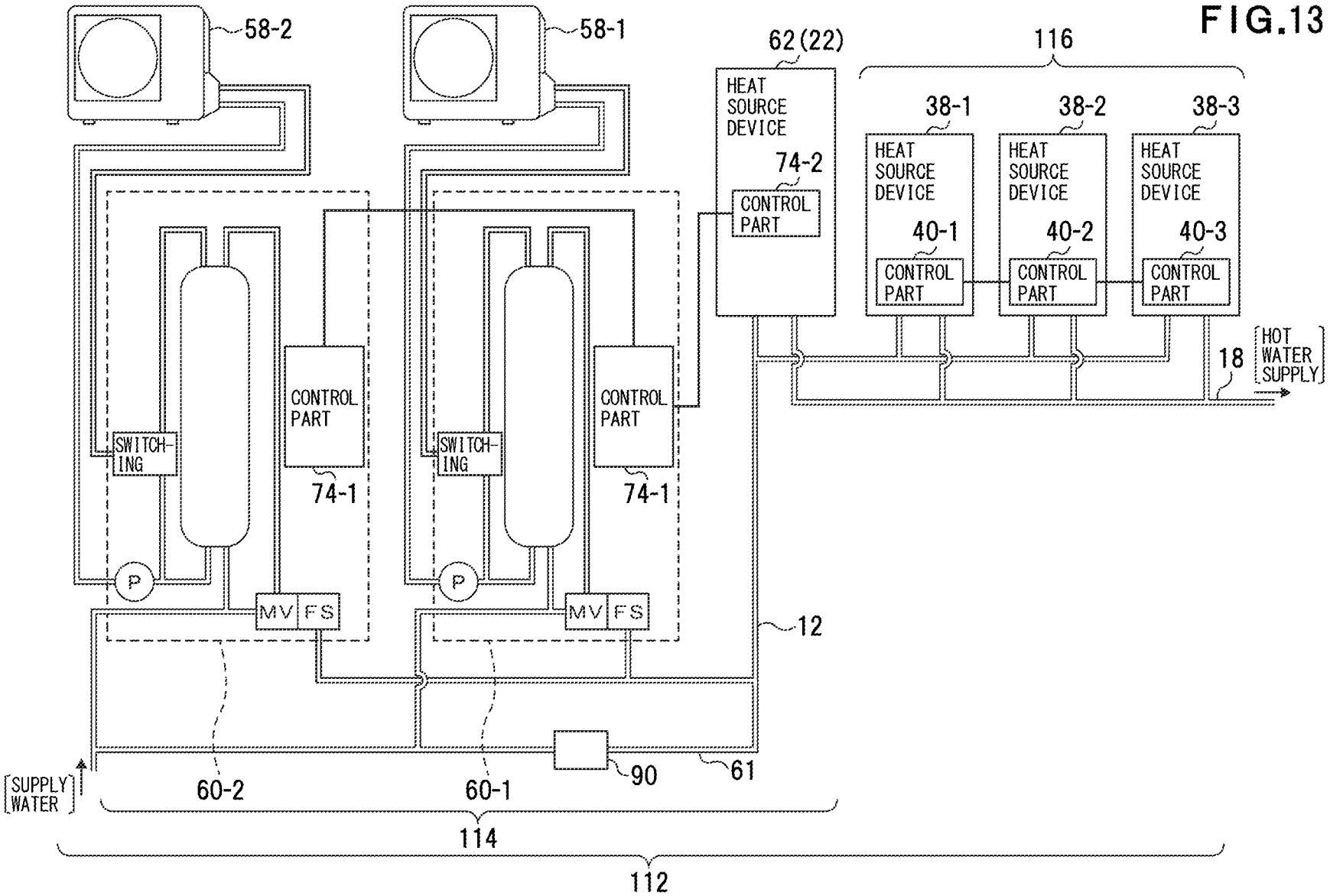
FIG. 13 is a diagram showing an example of a hot water supply system according to a third embodiment.

FIG. 13 shows an example of a hot water supply system according to a third embodiment. In FIG. 13, the same portions as FIG. 1 or 7 are denoted by the same reference signs.

A hot water supply system 112 includes the water supply path 12, a first heat source system 114, a second heat source system 116, and the hot water supply path 18. The hot water supply system 112 heats the supply water W supplied through the water supply path 12 and supplies the heated supply water W, i.e. , the hot water HW, from the hot water supply path 18. The water supply path 12 and the hot water supply path 18 are the same as those of the first embodiment and the second embodiment and will not be described. While the second heat source system 16 shown in FIGS. 1 and 7 includes the two heat source devices 38-1, 38-2, the second heat source system 116 includes three heat source devices 38-1, 38-2, 38-3. The second heat source system 116 is the same as the second heat source system 16 except for the number of the heat source devices and will not be described.

While the first heat source system 54 shown in FIG. 7 includes one set made up of the heat source device 58 and the hot water storage unit 60, the first heat source system 114 shown in FIG. 13 includes a first set made up of a heat source device 58-1 and a hot water storage unit 60-1, and a second set made up of a heat source device 58-2 and a hot water storage unit 60-2. The first heat source system 114 includes the first and second sets, a bypass water supply pipe 61, a heat source device 62, and a remote-control device not shown.

Both control parts 74-1 of the hot water storage units 60-1, 60-2 are connected to each other by wire or wirelessly and can communicate with each other. The control parts 74-1 are further connected to the control part 74-2 of the heat source device 62 by wire or wirelessly. Therefore, the control parts 74-1 have the function of the control part 26 and also have a function of controlling the hot water storage units 60-1, 60-2.

One of the control parts 74-1 is set to a master (master control part) , and the other is set to a slave (slave control part).

The master control part acquires through the slave control part the flow rate information of the supply water W detected by the flow rate sensor 24 connected to the slave control part. The master control part adds up the flow rate information acquired from the slave control part and the flow rate information of the supply water W detected by the flow rate sensor 24 connected to the master control ppart to obtain the first flow rate described in the first embodiment. The master control part obtains the first flow rate, monitors the first flow rate, and outputs the valve opening instruction signal or the valve closing instruction signal for the water regulation valve 34 to the heat source device 62 on the basis of the first flow rate.

The bypass water supply pipe 61 is connected in parallel to the hot water storage units 60-1, 60-2. Therefore, the supply water W is supplied to the second heat source system 116 and the heat source device 62 through at least one of the hot water storage units 60-1, 60-2 or the bypass water supply pipe 61.

The other configurations are the same as those of the first embodiment or the second embodiment and will not be described.

According to the third embodiment, for example, the same actions and effects as the second embodiment can be obtained. Additionally, according to the third embodiment, for example, the following actions and effects can be obtained.

(1) Since the hot water supply system 112 has two sets of the heat source device and the hot water storage unit, the supply amount of preheated hot water can be increased. The number of sets of the heat source device and the hot water storage unit may be one or three or more. Specifically, the number of sets of the heat source device and the hot water storage unit can be set in accordance with an expected hot water supply demand, for example. Adjusting the number of the sets in accordance with the expected hot water supply demand can reduce the carbon dioxide emissions in accordance with, for example, the expected hot water supply demand, and can reduce energy consumption, particularly, primary energy.

Modifications of the first embodiment, the second embodiment, or the third embodiment are listed below.

(1) The first set value SP1 and the second set value SP2 are set to, for example, 10 liters per minute and 5 liters per minute, respectively; however, other values may be used.

(2) The heat source devices 22, 62 of the first heat source systems 14, 54 are operated before the second operating heat source device of the second heat source system 16 is operated; however, the heat source devices 22, 62 may start operation after the second operating heat source device is operated and before the hot water supply capacity of the second heat source system 16 reaches the limit.

(3) The second heat source system 16 includes the two heat source devices 38-1, 38-2. However, the number of the heat source devices of the second heat source system 16 may be one or three or more. When the number of the heat source devices of the second heat source system 16 is three or more, the heat source devices 22, 62 of the first heat source systems 14, 54 are operated after the first operating heat source device of the second heat source system 16, or the heat source devices 22, 62 may start operation after the last heat source device of the second heat source system 16 is operated. When the heat source devices 22, 62 start operation after the last heat source device of the second heat source system 16 is operated, the hot water supply systems 2, 52 can supply the hot water HW under the independent control of the second heat source system 16 from the start of hot water supply to near the limit of the hot water supply capacity of the second heat source system 16 without depending on the control of the first heat source systems 14, 54. Since the heat source devices 22, 62 are operated before the hot water supply capacity of the second heat source system 16 reaches the limit, the hot water supply systems 2, 52 can accommodate the hot water supply demand exceeding the hot water supply capacity of the second heat source system 16.

To start operation of the heat source devices 22, 62 of the first heat source systems 14, 54 after the operation of the last heat source device of the second heat source system 16, for example, the maximum hot water supply capacity of the second heat source system 16 and the water supply flow rate during supply of the hot water HW at the maximum hot water supply capacity are grasped in advance, and the first set value SP1 is adjusted so that the heat source devices 22, 62 are operated before a flow rate is reached to such water supply flow rate, for example.

In a series of hot water supply operations of the hot water supply systems 2, 52, when all the heat source devices of the second heat source system 16 are in the operating state, the heat source devices 22, 62 of the first heat source systems 14, 54 start operation, the number of combustions, combustion time, and combustion load of the heat source devices 22, 62 are suppressed, and the life of the heat source devices 22, 62 can be extended. This can promote a shift of the hot water supply systems 2, 52 from the coexistence state of the first heat source systems 14, 54 and the second heat source system 16 to a system having only the first heat source systems 14, 54.

The number of heat source devices of the second heat source system 116 may be four or more. The heat source device 62 of the first heat source system 114 is operated after the first operating heat source device of the second heat source system 116, or the heat source device 62 may start operation after the last heat source device of the second heat source system 116 is operated.

(4) The second heat source systems 16, 116 adjust the heating operation of the second heat source systems 16, 116 in accordance with the flow rate (second flow rate) of the supply water W supplied to the second heat source systems 16, 116; however, the second flow rate may be a flow rate of the hot water HW supplied from the second heat source systems 16, 116. In other words, the second heat source systems 16, 116 may adjust the heating operation of the second heat source systems 16, 116 in accordance with the flow rate (second flow rate) of the hot water HW supplied from the second heat source systems 16, 116. In this case, the second heat source systems 16, 116 detect the flow rates of the hot water HW from the heat source devices 38-1, 38-2, 38-3 by flow rate sensors of the heat source devices 38-1, 38-2, 38-3, for example, and add up the flow rates of the hot water HW from the heat source devices 38-1, 38-2, 38-3 to obtain the second flow rate. Since the amount of the supply water W supplied to the heat source devices 38-1, 38-2, 38-3 is the same as or substantially the same as the amount of the hot water HW supplied from the heat source devices 38-1, 38-2, 38-3, the second heat source systems 16, 116 can adjust the heating operation of the second heat source systems 16, 116 in accordance with the flow rate of the hot water HW, as in the adjustment in accordance with the flow rate of the supply water W.

(5) The hot water supply systems 52, 112 include the bypass water supply pipe 61, and supply the supply water W through the multiple pipes arranged in parallel. However, the bypass water supply pipe 61 may be omitted. The supply water W may be supplied through the hot water storage unit 60, and the flow rate of the supply water W may be detected by the flow rate sensor 24.

(6) The flow rate sensors 24 of the hot water storage units 60, 60-1, 60-2 detect the flow rate of the supply water W; however, the hot water supply systems 52, 112 may include flow rate sensors or flow rate detecting means detecting the flow rate of the supply water W separately from the flow rate sensor 24.

(7) The control part 74-1 of the hot water storage units 60, 60-1, 60-2 of the first heat source systems 54, 114 outputs the valve opening instruction signal and the valve closing instruction signal; however, the hot water supply systems 52, 112 may have a control part outputting the valve opening instruction signal and the valve closing instruction signal separately from the control part 74-1. When the hot water supply systems 52, 112 have the control part outputting the valve opening instruction signal and the valve closing instruction signal separately from the control part 74-1, the load of the control part 74-1 can be distributed.

(8) The heat source devices 58, 58-1, 58-2 of the first heat source systems 54, 114 are not limited to the heat pump unit as long as water can be heated. The heat source devices 58, 58-1, 58-2 may be, for example, a solar water heater heating water with sunlight or a cogeneration system.

(9) The heat source devices 38-1, 38-2, 38-3 of the second heat source systems 16, 116 may be water heaters having the same configuration as the heat source device 62 shown in FIG. 8.

(10) In the embodiments, the control parts 26, 74-1 of the first heat source systems 14, 54, 114 output the valve opening instruction signal and the valve closing instruction signal to open and close the water regulation valve 34. For example, the water regulation valve 34 may be opened and closed via the control part of the heat source device 22 or the control part 74-2 of the heat source device 62. Specifically, the valve opening instruction signal and the valve closing instruction signal may be transmitted to the control part of the heat source device 22 or the control part 74-2 of the heat source device 62, or the control part of the heat source device 22 or the control part 74-2 of the heat source device 62 may open and close the water regulation valve 34.

(11) In the second embodiment, the first water supply flow rate is a flow rate equal to or less than the maximum water supply flow rate from the hot water storage unit 60 and is a flow rate greater than the first set value SP1, for example. The second water supply flow rate is a flow rate greater than the second set value SP2, for example. However, the first water supply flow rate and the second water supply flow rate may be other flow rates, and the control part 74-1 may output the valve opening instruction signal and the valve closing instruction signal in consideration of the flow rate of the supply water W supplied from the bypass water supply pipe 61.

(12) In the embodiments, the water regulation valve 34 is simply opened and closed. However, when the hot water supply demand exceeds the hot water supply capacity, the water regulation valve 34 may adjust the flow rate of water under the control of the control part.

As described above, the most preferable embodiment etc. of the present disclosure have been described; however, the present disclosure is not limited to the above description and can variously be modified and altered by those skilled in the art based on the spirit of the invention described in claims or disclosed in description, and these modifications and alterations naturally fall within the scope of the present disclosure.

INDUSTRIAL APPLICABILITY

The present disclosure is suitable and useful, in replacement of a portion of devices or enhancement of a hot water supply capacity of a heat source system installed in a small store or a large store, for parallel installation with this heat source system.

REFERENCE SIGNS LIST

2, 52, 112 hot water supply system
12 water supply path
14, 54, 114 first heat source system
16, 116 second heat source system
18 hot water supply path
22, 62 heat source device (first heat source device)
38-1, 38-2, 38-3 heat source device (second heat source device)
24 flow rate sensor
26, 74-1 control part
32 heating part
34 water regulation valve
36 individual water supply pipe
37 individual hot water supply pipe
58, 58-1, 58-2 heat source device (third heat source device)
60, 60-1, 60-2 hot water storage unit
61 bypass water supply pipe
64 hot water storage tank
66 circulation path
68 hot water outlet pipe
70 water supply pipe
72 mixing valve

The invention claimed is:

1. A heat source system that is to be connected to another heat source system, the heat source system comprising:

a heat source device including a water regulation valve configured to regulate a flow rate of supply water flowing in the device, the heat source device being configured to heat the supply water; and a control part connected to the heat source device, the control part being configured to acquire flow rate information of the supply water supplied to the other heat source system and the heat source device, to close the water regulation valve when a flow rate of the supply water is 0 or more and less than a first set value, and to open the water regulation valve when the flow rate of the supply water is equal to or greater than the first set value, wherein the another heat source system is operable independently of the control part of the heat source system, and wherein the first set value is less than a flow rate value when a second heat source device included in the other heat source system starts operation.

2. The heat source system according to claim 1, wherein the first set value is a value within a range from a flow rate value that is twice the minimum flow rate of a heating operation of the other heat source system to a maximum flow rate value.

3. The heat source system according to claim 1, wherein the first set value is a value within a range from a flow rate value that is twice the minimum flow rate of a heating operation of the heat source device to a maximum flow rate value.

4. The heat source system according to claim 1, wherein the control part closes the water regulation valve when the flow rate of the supply water is equal to or less than a second set value smaller than the first set value.

5. The heat source system according to claim 1, further comprising a flow rate detecting means connected to the control part to detect the flow rate of the supply water supplied to the other heat source system and the heat source device.

6. The heat source system according to claim 1, further comprising a water supply path connected to the heat source device, a water storage means connected to the water supply path to supply the supply water to the water supply path, and a heating means connected to the water storage means to heat the water stored in the water storage means.

7. A hot water supply system comprising:

a water supply path;

a heat source system connected to the water supply path to heat supply water supplied through the water supply path;

a heat source device connected to the water supply path, and connected in parallel to the heat source system, the heat source device including a water regulation valve configured to regulate a flow rate of supply water flowing in the device, the heat source device being configured to heat the supply water;

a flow rate detecting means disposed on the water supply path to detect a first flow rate of supply water supplied to the heat source system and the heat source device; and a control part connected to the heat source device and the flow rate detecting means to acquire flow rate information of the first flow rate from the flow rate detecting means, the control part being configured to close the water regulation valve when the first flow rate is 0 or more and less than a set value and to open the water regulation valve when the first flow rate is equal to or greater than the set value, wherein the heat source system is operable independently of the control part, and wherein the set value is less than a flow rate value when a second heat source device included in the heat source system starts operation.

8. The hot water supply system according to claim 7, wherein the heat source adjusts a heating operation of the heat source system in accordance with a second flow rate of supply water supplied to the heat source system.

9. A hot water storage unit capable of supplying water to a plurality of heat source devices, the hot water storage unit comprising:

a flow rate detecting means configured to detect a flow rate of supply water supplied from the hot water storage unit; and a control part connected to the flow rate detecting means, the control part being configured to acquire flow rate information of the supply water supplied from the hot water storage unit to output a first instruction signal when the flow rate of the supply water is 0 or more and less than a first set value and to output a second instruction signal when the flow rate of the supply water is equal to or greater than the first set value, wherein the plurality of heat source devices includes a first heat source device connected to the control part, and a plurality of second heat source devices operable independently of the control part, wherein the first instruction signal is an instruction signal for closing a water regulation valve configured to regulate a flow rate of water supply flowing in the first heat source device, and wherein the second instruction signal is an instruction signal for opening the water regulation valve, and wherein the first set value is less than a flow rate value when a second heat source device included in the plurality of second heat source devices starts operation.

10. A hot water supply method for supplying hot water from a hot water supply system including a heat source system and a heat source device, the method comprising:

acquiring flow rate information of supply water supplied to the heat source system and the heat source device;

closing a water regulation valve of the heat source device to supply hot water from the heat source system when a flow rate of the supply water is 0 or more and less than a set value; and opening the water regulation valve to supply hot water from the heat source system and the heat source device when the flow rate of the supply water is equal to or greater than the set wherein the heat source system is operable independently of a control part for the heat source device, and wherein the set value is less than a flow rate value when a second heat source device included in the heat source system starts operation.

11. A non-transitory computer readable recording medium storing a hot water supply control program for causing a computer to implement the functions of:

acquiring flow rate information of supply water supplied to a heat source system and a heat source device;

outputting a valve closing instruction signal to the heat source device when a flow rate of the supply water is 0 or more and less than a set value; and outputting a valve opening instruction signal to the heat source device when the flow rate of the supply water is equal to or greater than the set value, wherein the heat source system is operable independently of the computer, and wherein the set value is less than a flow rate value when a second heat source device included in the heat source system starts operation.

* * * * *